US009381385B2

(12) United States Patent
Fuhr et al.

(10) Patent No.: US 9,381,385 B2
(45) Date of Patent: Jul. 5, 2016

(54) PROTECTIVE SUIT FOR USE IN A COOLING CHAMBER

(75) Inventors: Guenter R. Fuhr, Berlin (DE); Heiko Zimmermann, Frankfurt am Main (DE); Klaus-Peter Hoffmann, St. Ingbert (DE)

(73) Assignee: Fraunhofer-Gesellschaft Zur Foerderung Der Angewandten Forschung E.V., Munich (DE)

( * ) Notice: Subject to any disclaimer, the term of this patent is extended or adjusted under 35 U.S.C. 154(b) by 225 days.

(21) Appl. No.: 13/983,268

(22) PCT Filed: Feb. 1, 2012

(86) PCT No.: PCT/EP2012/000452
§ 371 (c)(1),
(2), (4) Date: Aug. 1, 2013

(87) PCT Pub. No.: WO2012/104081
PCT Pub. Date: Aug. 9, 2012

(65) Prior Publication Data

US 2013/0305438 A1 Nov. 21, 2013

(30) Foreign Application Priority Data

Feb. 2, 2011 (DE) ..... 10 2011 010 119

(51) Int. Cl.
*A62B 17/00* (2006.01)
*A41D 13/005* (2006.01)
*H05B 3/34* (2006.01)
(Continued)

(52) U.S. Cl.
CPC ..... *A62B 17/00* (2013.01); *A41D 13/0051* (2013.01); *A62B 17/005* (2013.01); *H05B 3/34* (2013.01); *H05B 3/84* (2013.01); *A41D 19/01535* (2013.01); *H05B 2203/022* (2013.01); *H05B 2203/033* (2013.01); *H05B 2203/036* (2013.01)

(58) Field of Classification Search
None
See application file for complete search history.

(56) References Cited

U.S. PATENT DOCUMENTS 1,691,472 A 11/1928 Graham et al.
2,404,020 A * 7/1946 Akerman ..... A62B 17/00 128/201.28
2,410,632 A * 11/1946 Krupp ..... A62B 17/00 2/2.14

(Continued)

FOREIGN PATENT DOCUMENTS

CN 201545186 U 8/2010
DE 2751734 A1 11/1977

(Continued)

OTHER PUBLICATIONS

English-language abstract for DE 20 2004 008 966 U1.

(Continued)

*Primary Examiner* — Joseph M Pelham
(74) *Attorney, Agent, or Firm* — Caesar Rivise, PC

(57) ABSTRACT

A protective suit (100), especially for an operator (1) in a cooling chamber that is cooled using liquid nitrogen or vapor of the liquid nitrogen comprises a body suit (10) which has a thermally insulating, gas-tight cover material (20) and is designed to accommodate the operator (1), and a heating device (30) which is connected to the body suit (10) and is designed to heat the interior of the protective suit (100). A glove (70) which is made of a thermally insulating glove material (71) and includes a glove heater (77) is also described.

23 Claims, 12 Drawing Sheets

(51) Int. Cl.
*H05B 3/84* (2006.01)
*A41D 19/015* (2006.01)

(56) References Cited

U.S. PATENT DOCUMENTS

| | | | | | |
|---|---|---|---|---|---|
| 3,182,653 | A | | 5/1965 | Mavleos et al. | |
| 3,227,208 | A | * | 1/1966 | Potter, Jr. | A62B 7/06 128/201.21 |
| 3,367,319 | A | * | 2/1968 | Carter, Jr. | B63C 11/28 126/204 |
| 3,463,150 | A | | 8/1969 | Penfold | |
| 3,497,672 | A | * | 2/1970 | Sundstrom | F24H 1/102 126/204 |
| 3,558,852 | A | * | 1/1971 | Larenzo | B63C 11/28 126/204 |
| 3,559,209 | A | * | 2/1971 | Vail | B64G 6/00 128/201.19 |
| 3,564,614 | A | | 2/1971 | Getchell et al. | |
| 3,644,706 | A | * | 2/1972 | Larenzo | B63C 11/28 126/204 |
| 3,668,705 | A | * | 6/1972 | Garbisch | A42B 3/003 2/10 |
| 3,730,178 | A | | 5/1973 | Moreland | |
| 3,751,727 | A | | 8/1973 | Shepard et al. | |
| 3,815,573 | A | * | 6/1974 | Marcus | B63C 11/28 126/204 |
| 3,875,924 | A | * | 4/1975 | Bayles | A61F 7/03 126/204 |
| 3,884,216 | A | * | 5/1975 | McCartney | A61F 7/03 126/204 |
| 4,304,251 | A | | 12/1981 | Schaedel et al. | |
| 4,599,075 | A | * | 7/1986 | Nygard | B63C 9/087 2/2.16 |
| 4,881,539 | A | * | 11/1989 | Pasternack | A41D 13/0025 128/201.27 |
| 4,965,886 | A | | 10/1990 | Ockels | |
| 5,003,637 | A | | 4/1991 | Lonon | |
| 5,572,880 | A | * | 11/1996 | Frustaci | A62B 7/06 128/201.21 |
| 5,709,203 | A | | 1/1998 | Gier | |
| 5,829,061 | A | | 11/1998 | Visgil et al. | |
| 5,917,667 | A | * | 6/1999 | Turner | A42B 3/0426 2/209.14 |
| 6,055,670 | A | | 5/2000 | Parker | |
| 6,247,824 | B1 | * | 6/2001 | Berke | A42B 3/0426 2/209.14 |
| 6,681,589 | B2 | * | 1/2004 | Brudnicki | A62B 7/06 128/201.28 |
| 2002/0156509 | A1 | * | 10/2002 | Cheung | A61F 7/007 607/96 |
| 2003/0150554 | A1 | * | 8/2003 | Szczesuil | A41D 13/005 156/290 |
| 2004/0237178 | A1 | * | 12/2004 | Landeros | A62B 17/00 2/457 |
| 2006/0144557 | A1 | | 7/2006 | Koscheyev et al. | |
| 2006/0150305 | A1 | * | 7/2006 | Plut | A41D 13/002 2/457 |
| 2006/0156753 | A1 | | 7/2006 | Fuhr et al. | |
| 2009/0271917 | A1 | | 11/2009 | Richardson | |
| 2010/0281883 | A1 | * | 11/2010 | Romano | A41D 13/005 62/3.5 |
| 2011/0107504 | A1 | * | 5/2011 | Nunez | B63C 9/125 2/458 |
| 2013/0019611 | A1 | * | 1/2013 | Sims | A41D 13/005 62/3.3 |

FOREIGN PATENT DOCUMENTS

| | | | |
|---|---|---|---|
| DE | 202004008966 | U1 | 2/2005 |
| FR | 2630706 | A1 | 11/1989 |
| GB | 1415836 | | 11/1975 |
| GB | 2250908 | A | 6/1992 |
| JP | S49-121706 | U | 10/1974 |
| JP | S50-083151 | A | 7/1975 |
| JP | H08299017 | A | 11/1996 |
| JP | H10129248 | A | 5/1998 |
| JP | H10280211 | A | 10/1998 |
| JP | 2000328323 | A | 11/2000 |
| JP | 2006009170 | A | 1/2006 |
| JP | 2006111987 | A | 4/2006 |
| WO | 9937174 | A1 | 7/1999 |
| WO | 2005010499 | A2 | 2/2005 |

OTHER PUBLICATIONS

International Search Report for PCT/EP2012/000452 dated Nov. 14, 2012.
English language abstract for CN 201545186 U (2010).

* cited by examiner

A

B

A

B

PROTECTIVE SUIT FOR USE IN A COOLING CHAMBER

BACKGROUND OF THE INVENTION

The invention concerns a protective suit for use for an operator in a cooling chamber (cold room), in particular in a cooling system for cryopreservation of biological samples. The invention also concerns a glove for use with the protective suit or in a cooling system for cryopreservation of biological samples. Applications of the invention are given in operation of cooling systems for a long-term storage of samples in the cooled state, in particular for cryopreservation of biological samples.

It is known to store biological samples for the purpose of preservation in the frozen state in a cooling system, e.g. in a cryobank (cryopreservation). Cryobanks are typically operated at temperatures below −80° C., in particular at a temperature below the recrystallization temperature of water ice (−138° C.). They contain a cooling agent reservoir with liquid nitrogen (temperature: about −195° C.) and a plurality of individual tanks (so-called cryotanks, mostly Dewar flasks made of double-walled steel). The cryotanks stand in rooms at normal temperature (room temperature) in which operators may stay without particular protective measures. Conventional cryobanks with individual cryotanks have disadvantages when large sample quantities, such as ten thousand up to a million or more samples are to be cryopreserved. Limitations occur as to the effectiveness of the cryotank operation, for the provision of constant cooling conditions and for the automation when operating the cryobank, in particular the sample handling. To overcome these limitations, there is the interest to replace the conventional cryotanks with larger storage units.

An extended cooling system, which is suitable for the cryopreservation of biological samples is described by the inventors of the present invention in a further patent application (not yet published at the priority date of the present invention). The cooling system comprises a cooling chamber and a cooling device, which are provided for cooling of the cooling chamber with liquid nitrogen. Although the cooling system runs fully automatically or semi-automatically in the normal operation mode, i.e. nobody is required to inspect it, operators must be able to inspect it in the cases of maintenance and damage. Without protective measures, humans can, however, not enter rooms with temperatures below −70° C., since frostbites of the skin, the eyes and the lung would be unavoidable and would lead to life-threatening conditions even after a short period of time. For example, it is known that, at the cold poles of the Earth, at temperatures below −60° C., physical activities of the human being with strong inhalation lead to frostbites at the pulmonary alveoli.

Protective measures for human beings in a life-hostile environment are generally known, such as space suits for use in the universe or diving suits. Space suits are, however, not suitable for cooling systems. Space suits require cooling of the astronaut, since overheating of the suit is probable in the free space due to the missing convection. U.S. Pat. No. 3,730,178 A describes a diving suit, which is equipped with a heater. This diving suit is, however, due to its poor thermal insulation capacity and a missing low-temperature resistance of the materials used, not suitable for use in a cooling system.

DE 20 2004 008 966 U1, U.S. Pat. No. 3,182,653 A and US 2006/0144557 A1 describe electric heatable garments, e.g. in the form of an overall, the application of which, however, is restricted to keeping warm the wearer during outdoor activities, such as when hunting, camping or staying in polar regions. These garments are not suitable for protection at temperatures below the low temperatures that occur in nature (approximately −50° C.).

The objective of the invention is to provide an improved protection of an operator in a cooling system for cryopreservation of biological samples, wherein disadvantages and limitations of conventional protective measures are overcome.

This objective is achieved by a protective suit having the features of the invention.

DESCRIPTION OF THE INVENTION

According to the invention, the above-mentioned objective is achieved by the general technical teaching to provide a protective suit, in particular for an operator in a cooling chamber with a temperature below −100° C., in particular below −150° C., e.g. −190° C. or less, which comprises a body suit for accommodating the operator and a heating device for heating the body suit. The protective suit is adapted for use in a cooling chamber, which is in particular cooled with liquid nitrogen or vapor of the liquid nitrogen. According to the invention, the body suit is made of a thermally insulating sheath material (envelope material). The sheath material forms a gas-tight sheath for the operator. The heating device is connected with the body suit and adapted to the thermal conductivity of the sheath material in such a manner that a physiologically acceptable temperature (temperature above −30° C., in particular above −10° C., e.g. 0° C. or more) is provided inside the body suit. The heating device or parts thereof are connected to the sheath material of the body suit in such a manner that it can directly be tempered by the heating device. The inventors have found that with the combination of a thermally insulating sheath material and a heating device connected to it, a protective suit can be provided which offers even at extremely low temperatures in a cooling chamber, which is cooled with liquid nitrogen, a reliable protection for a person wearing the protective suit. The protective suit provides a complete and safe thermal insulation of the whole body of the operator. Simultaneously, the heat loss by the operator to the cooling chamber is minimized. The operator may wear normal clothing, laboratory clothing or also warming (lined) textile clothing in the protective suit.

The heating device has a double function, firstly to provide a sufficient temperature inside the body suit and secondly to be able to warm up the sheath material and/or further parts of the body suit, such as articulation regions, in such a way that sufficient flexibility is given at the low temperature in the cooling chamber in order to ensure the mobility of the operator in the cooling chamber.

The protective suit according to the invention offers protection for the whole body of the operator, in particular the legs, feet, arms and hands against undercooling, even in the case of direct contact of the external side of the protective suit with liquid nitrogen. The operator wearing the protective suit can move freely in the cooling chamber and use the protective autonomously. The use in the cooling chamber is possible for a duration of at least 10 minutes, in particular at least 30 minutes, for example 60 minutes or longer.

According to a preferred embodiment of the invention, the heating device comprises an electric resistance heater. The resistance heater can advantageously be easily embedded in the sheath material of the body suit or positioned on its inner surface. The resistance heater is furthermore advantageous with regard to the power supply via an electric cable connection with an internal and/or an external current source and a short reaction time in the case of change of the temperature in the body suit. Particularly preferably, the electric resistance heater comprises heating layers, which are positioned in a distributed manner in the body suit. Heating layers comprise layer-shaped resistance materials, such as metallic alloys, tungsten, plastic foils vapour-coated with heating resistors, or indium-tin oxide layers. Heating layers have the advantage of minimally impairing the comfort of wearing for the operator.

According to a modified embodiment of the invention, the heating device can comprise a heating medium circuit, which extends into the body suit. The heating medium circuit is embedded in the sheath material of the body suit or positioned on its inner surface and connected with an internal and/or external heating medium source for a gaseous or liquid heating medium, such as air or silicone oil. The use of the heating medium circuit may be advantageous with regard to the effectiveness of the heater and a uniform distribution of the heat in the body suit. Particularly preferably, the heating medium circuit comprises a plurality of lines, which are arranged in the body suit in a distributed manner and form one or more ring lines (partial circuits).

According to a further preferred embodiment of the invention, the sheath material has a multi-layer structure of at least two sheath layers (layers). The multi-layer structure is advantageous with regard to the adaptation of the sheath material to a mechanical protective and sealing function and to a thermal insulation function. Thus, an outer sheath layer can be formed from a material that is designed for sealing and mechanical protection, whereas a further, inner sheath layer forms an insulation layer. Particularly preferred is a structure for which the outermost sheath layer comprises a gas-tight outer skin, e.g. from polymeric, e.g. PTFE, metal vapor-depositions, silicone coating, ceramic or lacquers, under which a stabilization layer, e.g. made of textile fabrics, metal fabrics and metal nets, cellulose compounds, plastic nets, carbon fabrics, tear-resistant foils, rubber or combination of these materials, and the insulation layer, e.g. made of polymer foam, polystyrene, silicone foam, glass wool, vacuum insulation panels, wood, cork, mineral wool, powder, follow inwardly. A heating region may form a separate, innermost sheath layer, wherein at least parts of the heating device, such as the heating layers or the lines of the heating medium circuit, are arranged in the heating region. The insulation layer may optionally be fitted with a heat reflective foil, e.g. with a metal coated plastic foil. The sheath material may in particular bear further layers on its external side.

Typically, the insulation layer is made of a plastic material with a thermal conductivity below 0.1 or below 0.05 W/(m·K).

Advantages for a particularly effective thermal insulation of the interior of the body suit can result according to a further variant of the invention when, alternatively or additionally to the insulation layer, a further, gas-filled or evacuated intermediate layer is provided for. For this embodiment of the invention, the sheath material contains at least one inflatable or evacuated intermediate layer, which is preferably arranged inside or outside, adjacent to the heating region.

According to a preferred embodiment of the invention, the sheath material of the body suit is bendable. The movability of the operator is thus advantageously made easier. The flexibility is realized at any temperature in the cooling chamber, in such a way that at least the outer layers of the sheath material are formed by a plastics material, which is pliable at −200° C. and/or are heated up by the heating device to a temperature above −200° C. at which the outer layers of the sheath material are pliable.

According to an alternative embodiment of the invention, the sheath material of the body suit is rigid, wherein parts of the body suit are connected via articulation regions. In this case, less demands are advantageously made on the materials of the outermost sheath layers and/or the respective heating thereof. However, if necessary, the articulation regions must be heated in order to remain flexible at a low temperature.

According to a particularly preferred embodiment of the invention, in particular when using a bendable sheath material or in the material of the articulation regions, the position of the heating device in the layer compound and the thermal conductivity of the materials used are selected in such a manner that there is a heat flow from the heating device to the largest extent inwards and to a smaller extent outwardly. In other words, more than half, preferably more than 75% of the heat flow flows inwards, whereas the remaining heat flow flows outwardly and heats up the outer sheath region layers or articulation region layers. The heating device is operated with such power that in the interior of the protective suit the physiologically acceptable temperature is reached and the outer sheath region layers or articulation region layers are heated up to a temperature at which they are pliable at an ambient temperature below e.g. −90° C.

The position of the heating device may for example be selected in such a way that it is arranged on the inner surface of the sheath material. In this case, the interior of the protective suit can be heated up in particularly effective manner. To maintain the flexibility of the outer sheath layers, the sheath material would be selected with a lower thickness. For this variant, there is an increased energy consumption of the heating device, wherein, however, due to the low thickness of the sheath material, a low weight of the protective suit is achieved as well as greater ease as far as mobility is concerned.

Alternatively, the heating device may be embedded in the depth of the sheath material. In this case too, the portions of the heat flow from the heating device that flow inwardly or outwardly may be selected in such a way that the outer sheath layers and the interior of the protective suit are effectively warmed and, nevertheless, the thermal insulation of the operator with respect to the environment is still good.

Preferably, the body suit having the bendable sheath material is provided on a front side with an access opening where layers of the sheath material are arranged in an overlapping manner. In the case of a multi-layer structure of the sheath material, a stepped overlapping region is provided for. For a body suit with a rigid sheath material and articulation regions, the access opening is preferably provided for in a shoulder region or a trunk region of the body suit. In the connection regions, rigid or pliable connection elements may be provided for that lock and seal the interior of the protective suit during assembly.

Advantageously, the body suit of the protective suit according to the invention may be equipped with a helmet. The helmet is arranged on the upper part of the body suit and is configured for gas-tight inclusion of the operator in the head region. The helmet comprises a mechanically stable component part, which completely surrounds the head of the operator and is connected with the body suit in a gas-tight manner, having a transparent front window at least in the viewing direction of the operator. Particularly preferably, the helmet has a shape, which is adapted to the shape of the head, in particular the shape of a ball or a ball section. If at least the front window, preferably the whole helmet, is formed out of a double-walled, evacuated window material, this will prove advantageous for the thermal insulation of the interior of the helmet. Particularly preferably, a ball or a ball section made of a double-walled, evacuated material is provided for.

The helmet may advantageously take on at least one of the following additional functions of the protective suit. According to a variant, the helmet may be provided with a pressure relief valve via which, in the case of malfunction of the breathing air supply, any overpressure may be relieved in the protective suit. According to a further variant, the helmet may be equipped with a window heater in order to improve the visibility of the operator. The window heater consists e.g. of a transparent heating material, such as ITO (indium-tin oxide). According to a further variant, the helmet may be equipped with a rear-view mirror, whereby the backward visibility is improved for the operator and the requirements on the mobility of the protective suit are reduced. Furthermore, the helmet may be equipped with a coupling device via which the protective suit can be connected via a supply line with a further protective suit or an emergency supply device.

Further advantages of the invention can result if the body suit is subdivided into leg, trunk and arm parts, which are interconnected via the articulation regions. The leg and arm parts are elongated sections of the body suit, which may be equipped with further articulation regions in the area of the knee and the ankle joint or the elbow and the wrist. The provision of the articulation regions that the advantage that less requirements may be made on the flexibility of the sheath material without impairing the mobility of the operator in the cooling chamber.

According to a further variant of the invention, the body suit is equipped with a belt device, which preferably surrounds the trunk part and, optionally, parts of the leg parts. Advantageously, an external support apparatus such as a holding rope may be coupled with the belt device. In case of emergency, the operator wearing the protective suit can be pulled out of the cooling chamber in a reliable manner using the support apparatus. Furthermore, the belt device may be used during normal operation for strapping on loads on the protective suit.

The protective suit according to the invention may advantageously be equipped with an emergency supply device, which comprises a breathing air reservoir in the protective suit and/or a coupling device for connection with an external supply apparatus. The breathing air reservoir comprises e.g. a compressed air bottle, a heating cartridge and a valve-controlled connection line between the compressed air bottle and the interior of the protective suit. The breathing air reservoir may e.g. be integrated in the helmet of the body suit.

Further components of the protective suit, which are preferably arranged in the helmet, comprise a lighting equipment for lighting the environment of the protective suit, a sensor device for detection of the oxygen content, the temperature and/or of physiological properties of the operator, an alarm device for warning the operator against undesirable operating states and/or a communication device for wireless or wired communication by the operator with further helpers within or outside of the cooling chamber.

The protective suit according to the invention has shoes for accommodating the feet of the operator. Particular requirements are made with regard to the mechanical and thermal protection of the operator on the shoes for use in cooling chambers, which are typically cooled from the floor up using liquid nitrogen. In this regard, the shoes have at least one the following features. Plateau soles with a thickness of at least 4 cm, in particular at least 6 cm are provided for. The plateau soles offer the option of an effective thermal insulation and increase the distance from the shoes to a cooling device with liquid nitrogen provided in the floor of the cooling chamber. Optionally, the plateau sole may be equipped with sole profiles, which allow a reduction of the contact surface between the shoe and the floor. Furthermore, the shoe may be equipped with sole hollow spaces. They comprise gas-filled or evacuated regions in the sole. This advantageously improves the thermal insulation of the shoes. Furthermore, the shoes may be provided with protective layers against mechanical injuries, e.g. using ceramic.

Typically, the interior of the shoes is dimensioned in such a way that sufficient space is given for movement of the foot in the shoe, even if the operator wears thermal protection clothing. In order to nevertheless guarantee a reliable load transmission from the leg or the foot to the leg part and the shoe of the protective suit, pliable adaptation elements are preferably provided in the leg part or in the shoe, which elements are configured for accommodating a part of the leg or of the foot of the operator and for providing support in the protective suit.

The protective suit according to the invention can be connected via a supply line, in particular a heated hose pipe, with an external breathing air supply system. Preferred is, however, an embodiment the invention for which a breathing air source is provided in the protective suit. The breathing air source is adapted for supplying breathable air into the interior of the protective suit. Typically, the breathing air source is accommodated in a back part of the protective suit. In order to provide physiologically breathable air, part of the heating device is configured for heating the air provided by the breathing air source.

The breathing air source that the additional advantage that the protective suit can be impinged with an overpressure compared with the environment in the cooling chamber. The overpressure may be selected in such a way that physiological breathing conditions are given in the protective suit and the interior of the body suit or parts of the latter under the action of the inner pressure are unfolded (inflated). This advantageously achieves additional thermal insulation. Alternatively, the protective suit may be equipped with a compressed air source, which is independent from the breathing air source for generating the overpressure.

Preferably, the protective suit according to the invention is equipped with at least one glove for accommodating a hand of the operator. The glove is made of a thermally insulating glove material and is provided with an electric glove heater and/or a glove heater supplied with heating medium. The glove may be firmly connected with the body suit or detachable from the latter. The glove material preferably is structured like the sheath material.

The glove may be used independently from the body suit in cooling systems for handling cooled objects. The glove as such therefore represents an independent subject-matter of the present invention.

The at least one glove comprises at least two, preferably at least three, particularly preferably five finger chambers, which are individually movable. Advantageously, the at least one glove allows grasping of objects such as sample containers in the cooling chamber.

Preferably, the interior of the at least one glove is dimensioned in such a way that at least the fingers, preferably the whole hand, of the operator can freely move in the glove. In order to nevertheless guarantee load transmission from the hand to an object to be grasped, the glove is equipped with holding elements, which are configured for accommodating or supporting part of the hand, the wrist or the forearm of the operator in the glove. Advantageously, the hand can be moved in the glove so that the fingers are in different positions relative to the glove. In a first position, the fingers can be arranged in the vicinity of the glove heater, preferably on the rear side of the glove. In a second position, the fingers can lie on the grasp sides of the finger part in order to grasp an object.

Particularly preferably, the finger chambers of the at least one glove are provided with grasp areas in which the glove material has a reduced thickness compared with the rest of the glove. The grasp areas are arranged and dimensioned in such a way that contact surfaces can be formed between adjacent fingers, just as given when grasping an object with a hand without a glove. The thermally insulating glove material has a particular thin design in the grasp area in order to achieve finger pressure sensing for the operator. The grasp areas allow for that the operator has a feel for grasping an object. Advantageously, the grasp areas on the external side of the glove may have a profiled surface. This allows secure grasping even of small objects such as sample tubes or the like.

Furthermore, the at least one glove is particularly preferably configured to be subjected to an inner pressure so that sufficient space is formed in the interior of the glove for a movement of fingers from a grasping position with a contact of the fingers with the glove material, in particular the grasp areas, into a heating position without a contact of the fingers with the glove material. In connection with the remaining body suit or a cooling system, the glove can be inflated, e.g. with dry or warming air, in order to establish the inner pressure.

The at least one glove may be equipped according to a further variant of the invention with receptacles for sample carriers. The receptacles for sample carriers are e.g. arranged on an external side of the glove and serve for intermediate storage of a sample carrier removed from a shelf device prior to its transfer to another shelf device or a transport container.

The protective suit according to the invention has following further advantages. Due to the internal breathing air source with tempering, the protective suit can be used in the cooling chamber in air or also in a pure nitrogen atmosphere. Good mobility of the extremities of the operator is given even at low temperatures, e.g. up to −190° C. or lower. A physiological temperature of the operator can be maintained in the protective suit. The temperature can be controlled by the operator or automatically adjusted by a control unit. The protective suit allows rapid placement or deposition by the operator, which is advantageous for normal operation of the cooling system and also in case of damage. The at least one glove provides good graspability for the hands and secure physiological tempering.

BRIEF DESCRIPTION OF THE DRAWINGS

Further details and advantages of the invention will be described below with reference to the attached drawings. The figures show as follows:

FIGS. 1A and 1B schematically illustrate two embodiments of the protective suit according to the invention 100. The protective suit 100 comprises respectively a body suit 10 made of a sheath material 20 (see FIGS. 2 bis 4) with a helmet 40 (see FIG. 5), shoes 50 (see FIG. 6), a back part 60 with a breathing air source (see FIG. 14), and gloves 70 (see FIGS. 7 to 11). Furthermore, the protective suit 100 comprises a schematically shown heating device 30 (see FIGS. 2 to 4). The body suit 10 comprises two leg parts 11 for accommodating the legs, a trunk part 12 for accommodating the trunk and two arm parts 13 for accommodating the arms of the operator 1. The whole compound of the sheath material 20 with an access opening and the coupling between the body suit 10 and the helmet 40 are formed gas-tight. They are in particular impermeable for moisture (water vapor) in order to keep a cooling chamber ice-free and frost-free when the operator 1 steps in wearing the protective suit 100.

Figure 1:
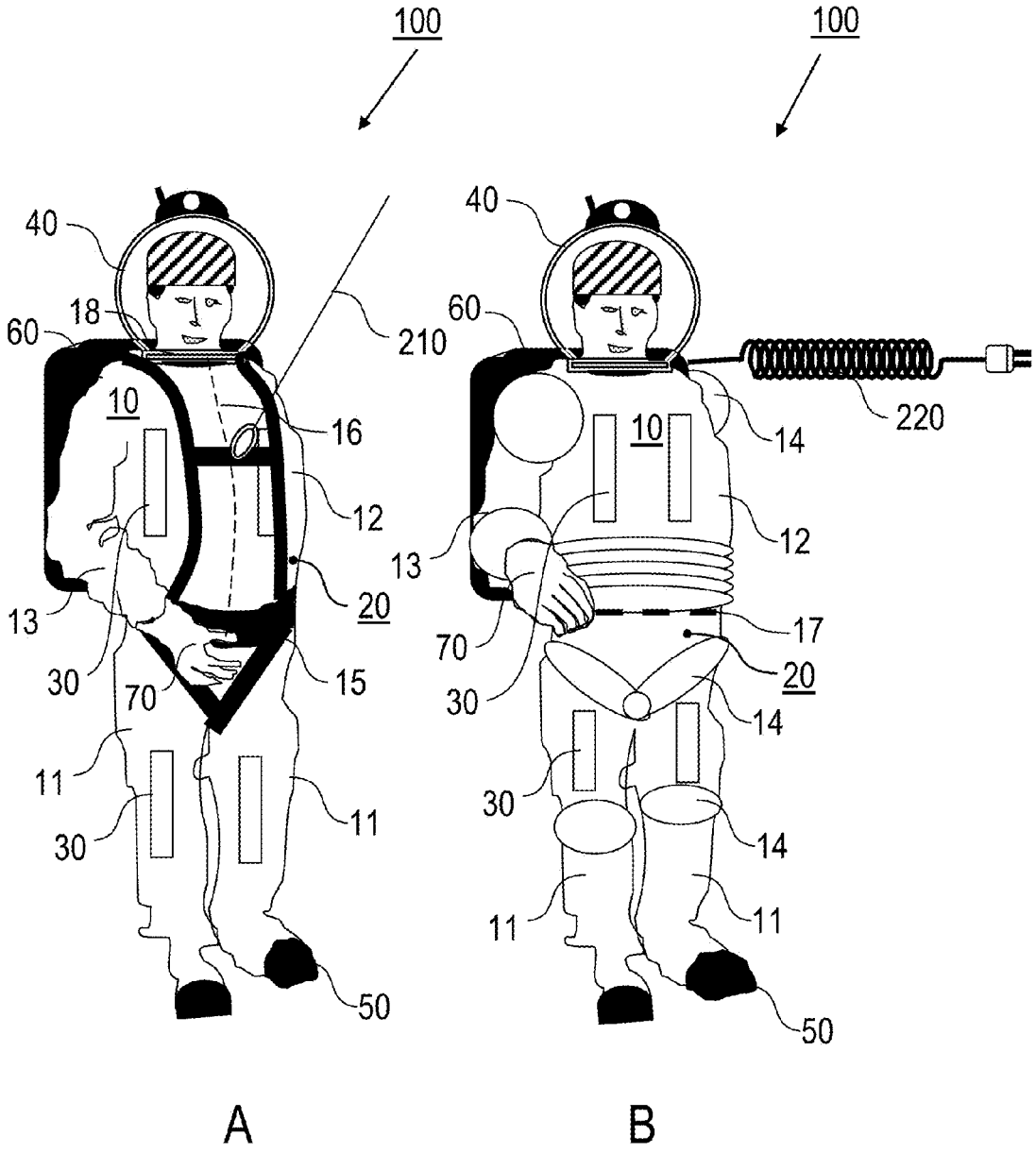
FIGS. 1A and 1B: two embodiments of a protective suit according to the invention.

The embodiments in FIGS. 1A and 1B differ with regard to features of the sheath material 20 and the operating pressure in the protective suit 100. According to FIG. 1A, the sheath material 20 has a layer structure with several sheath layers arranged directly one above the other. Inflatable or evacuated intermediate layers are not provided in this case. The material of the sheath layers and the layer sequence are selected in such a way that the major part of the heat supplied by the heating device 30 flows inwardly, whereas the sheath material 20 warms up outwardly so that it remains flexible even at low temperatures in the cooling chamber. The surface temperature of the sheath material 20 required to this end must not be greater than 0° C. Many usable fabrics, plastic materials or silicone materials are still flexible in the range of −10° C. to −50° C., so that the surface temperature of the sheath material 20 can be adjusted in this range. The advantage of the embodiment according to FIG. 1A consists in the thinner, simpler and easier structure of the body suit along with lower technical expenditure. Disadvantageous are, in contrast, the increased heat loss to the environment and thus the increased energy consumption.

According to FIG. 1B, the protective suit 100 forms a pressure suit. When using the protective suit 100, an increased inner pressure in the sheath material 20 and/or inside the body suit 10 is adjusted there so that the sheath material 20 bends outwardly. In this case, the sheath material 20 has a larger wall thickness compared with the embodiment according to FIG. 1A. Furthermore, the sheath material 20 is rigid at least at low temperature in the cooling chamber. The articulation regions 14 are provided in order to nevertheless guarantee free mobility of the operator 1 wearing the protective suit 100.

The body suit 10 and the helmet 40 form together a gas-tight sheath for the operator 1. For the embodiment according to FIG. 1A, no pressure-stable tightness must be produced in a cold nitrogen atmosphere in the cooling chamber at normal pressure. Accordingly, an access opening can be formed for the operator 1 by interruption of the sheath material 20 along an opening line 16. In the front region of the trunk part 12 are arranged overlapping layers of the sheath material 20 adjacent to the interruption. The overlapping layers can be interconnected or separated from one another with a fastener, such as a quarter-turn fastener, hook-and-loop fastener with elastic and sealing bands, in order to open or to close the access opening.

According to FIG. 1B, the access opening is provided by a two-part structure of the body suit 10. The sheath material 20 is interrupted between the leg part 11 and the trunk part 12. Rigid coupling rings 17 (drawn dashed) are at the borders of the adjacent parts 11, 12. The coupling rings 17 are adapted for gas-tight and pressure-tight coupling of the parts 11, 12. They form e.g. a quarter-turn fastener with a sealing layer provided for between the coupling rings 17.

The heating devices 30 schematically shown in FIGS. 1A and 1B comprise e.g. electric heating layers or lines of a heating medium circuit, as will be described below with further details. The parts of the heating device are arranged in a distributed manner in the body suit 10 and/or in the back part 60. They are in particular positioned in regions in which, when using in the cooling chamber, a relatively large amount of heat flows off, such as at the leg and arm parts 11, 13. In the shoes 50 and the gloves 70 are preferably provided electric heating elements, such as heating layers.

The helmet 40 is fixed and locked gas-tight at a coupling ring 18 on an upper end of the body suit 10. On the rear side of the coupling ring 18, a hinge can be provided on which the helmet 40 can be folded backwards in an unlocked state in order to facilitate the operator 1 getting out of the protective suit 100.

The back part 60 is located on the back side of the trunk part 12. The back part 60 may be firmly connected with the sheath material 20 connected or with the body suit 10 by means of belts like a rucksack. In the back part 60 is located the breathing air source, a part of the heating device for heating the breathing air, a current source, in particular a battery, a control unit, and if necessary an additional compressed air source. The back part 60 is formed of a thermally insulating material, e.g. coated carbon fabric, resin foam composite, glass wool composite material, expanded polystyrene, in order to protect said components against undercooling.

Figure 7:
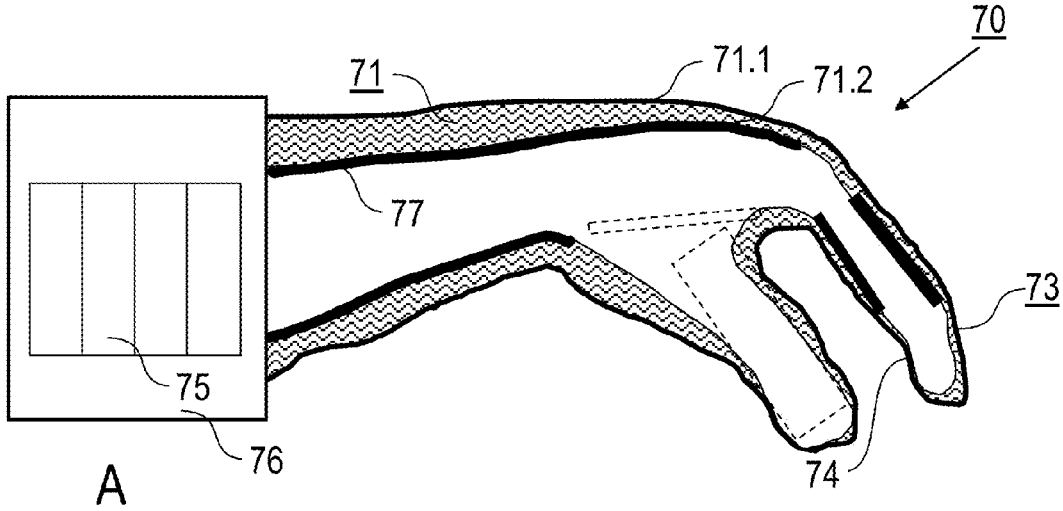
FIGS. 7A and 7B: schematic cross sectional views of a glove according to the invention.
Figure 7:
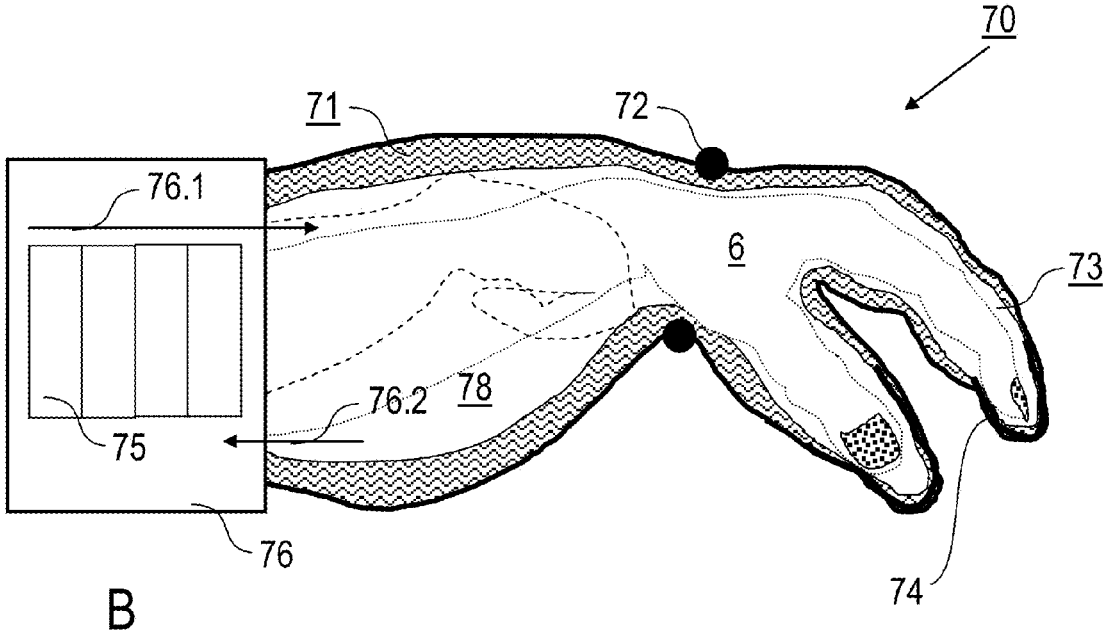
Figure 8:
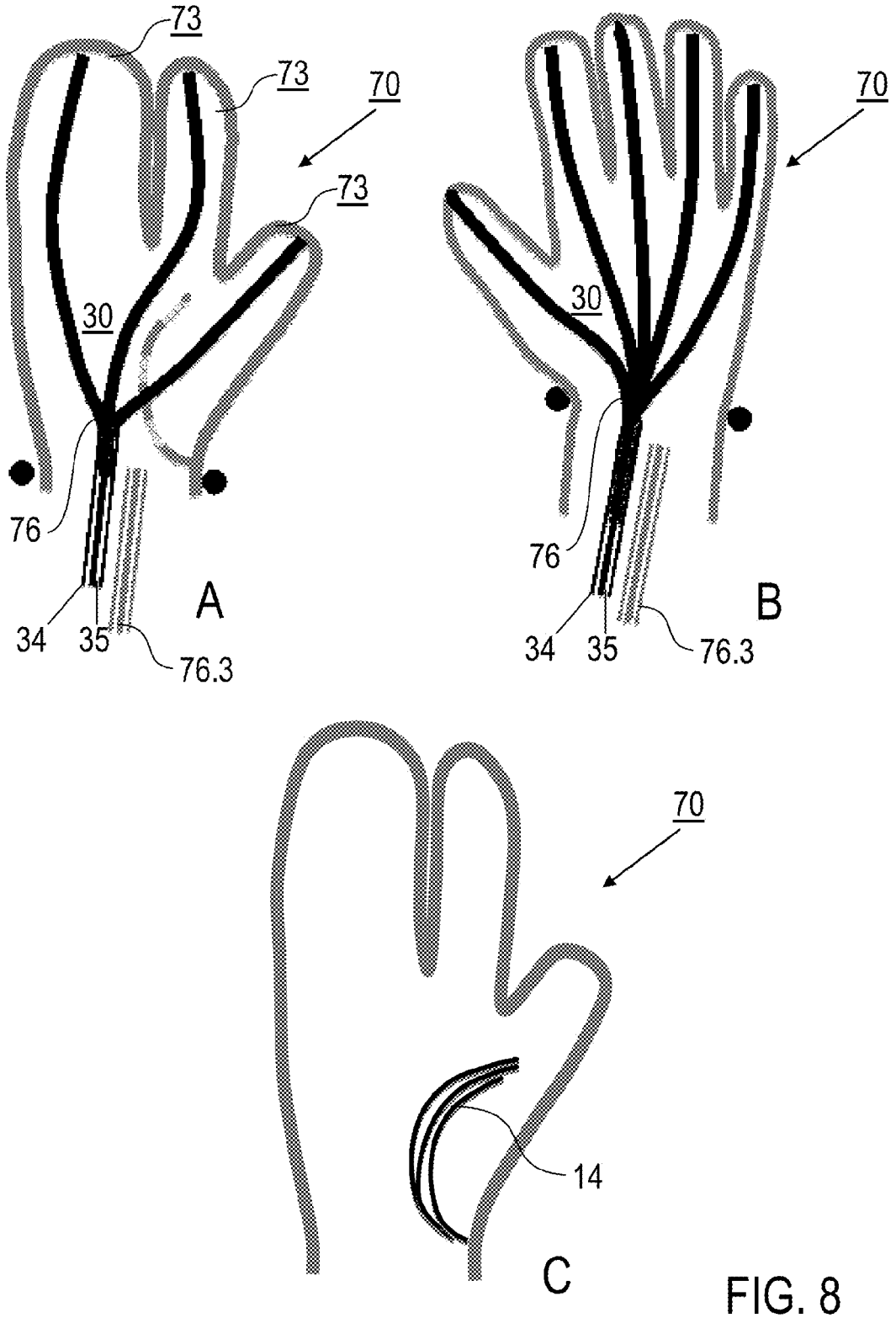
FIGS. 8A to 8C: schematic illustrations of further features of the glove according to the invention.

The shoes 50 and the gloves 70 can be permanently connected with the body suit 10. Alternatively, separation of the shoes 50 and/or the gloves 70 from the body suit 10 is provided for. In this case, the shoes 50 and the gloves 70 are provided with coupling elements (see FIG. 7) in order to achieve a gas-tight and, if necessary, pressure-tight connection with the body suit 10. The front ends of the shoes 50 (tiptoes) are mechanically reinforced and insensitive against contact with liquid nitrogen. The shoes 50 are in this regard formed out of a plastic material or ceramic as used in conventional cryotechnology for cryotanks.

FIG. 1A furthermore illustrates the optionally provided belt device 15. The belt device 15 can be embedded in the sheath material 20 or arranged on the surface of the sheath material 20. A holding rope 210 with which the operator 1 can be secured in the protective suit 100 or can be lifted from the cooling chamber in a situation of damage can be fixed on the belt device 15.

The use of the protective suit 100 according to FIG. 1A is such that, at first, the helmet 40 is folded back and the trunk part 12 is opened along the opening line 16. The operator 1 get into the body suit 10. Here, the operator 1 may wear normal clothing or a warming textile clothing (lined textiles), e.g. a lined headgear (shown hatched). Following this, the access opening is closed along the opening line 16 and the helmet 40 is folded forward and closed at the coupling ring 18. Simultaneously, the breathing air source is operated in the back part 60 in order to supply the operator 1 with breathing air. In this situation, the operator wearing the protective suit 100 is ready to work and to enter a cooling chamber.

The cooling chamber comprises e.g. a floor area, side walls and a ceiling area, wherein a cooling device is arranged at least in the floor area for cooling the cooling chamber using liquid nitrogen. The side walls are typically formed closed (without a door opening). The access to the cooling chamber is done through an opening in the ceiling area. In the floor area is arranged a working platform on which the operator wearing the protective suit 100 can move in order to e.g. carry out maintenance work or take or deposit sample containers.

According to FIG. 1B, it is accordingly provided for that the operator 1 initially gets into the leg parts 11 of the body suit 10 and then the trunk and arm parts 12, 13 and puts the helmet 40 on. The protective suit 100 is closed gas-tight and pressure-tight at the coupling ring 17. Simultaneously, the breathing air source is put into operation in the back part 60 in order to supply the operator 1 with breathing air.

Providing a current source in the back part 60 is not mandatory. As a substitute, connection with an external energy source may be provided via a supply line 220, which is shown schematically in FIG. 1B and with further details in FIG. 13.

FIGS. 2A and 2B show two variants of the sheath material 20, which is preferably provided for the embodiment of the protective suit 100 according to FIG. 1A. In both cases, the sheath material 20 comprises from the outside inwards a gas-tight outer skin 21, a stabilization layer 22, an insulation layer 23 with a heat reflective foil 24, a heating region 25, a storage layer 26 with an inner skin 27 and a textile layer 28. The body surface (clothing surface) of the operator 1 is designated with reference numeral 2.

The outer skin 21 comprises a gas-tight composite material, which contains a fabric, e.g. coated plastic nets, glass wool, carbon fabric, laminated foil, and/or coated foam. The thickness of the outer skin 21 is e.g. 0.5 mm to 3 mm. The stabilization layer 22 is likewise a composite material in which a mechanical stable grating material, e.g. from a plastic material, is embedded. The thickness of the stabilization layer 22 is e.g. 0.1 mm to 2 mm. The insulation layer 23, e.g. with a thickness of 3 mm to 10 mm is e.g. formed out of polyurethane foam, polyethylene foam, cork, glass foam granulate, aerogel, vacuum insulation panels, mineral wool, wherein the heat reflective foil 24, comprising a plastic foil coated with aluminium, is arranged on the inner side the insulation layer 23. The heating region 25 comprises heating layers, which are arranged uniformly distributed and stratiform in the sheath material 20. The heating layers are supplied via electric cables (not represented), which are connected with the current source in the back part 60 (see FIG. 1) and/or via the supply line 220 with an external current source. The storage layer 26 comprises a material with a high heat capacity, such as paraffin, wax, magnesium composite material, graphite layers, polystyrene foam, wood constituents with a specific heat capacity greater than 1 kJ/kg K. It has a thickness of e.g. 2 mm to 10 mm. The storage layer 26 serves as a thermal buffer and for distribution of the heat. The inner skin 27 has a mechanical stabilization function. Finally, the textile layer 28 consists of a textile fabric or felt in order to design the inner contact between the operator 1 and the sheath material 20 as comfortable as possible.

According to FIG. 2A, the body surface 2 of the operator 1 is in direct contact with the inner side of the sheath surface 20. Thus, the body surface 2 is directly warmed up by the sheath material 20. Deviating therefrom, it is provided for according to FIG. 2B that the breathing air is supplied in the body suit 10 with a pressure which is greater than the outer atmospheric pressure in the cooling chamber. As a result, the sheath material 20 is blown-up, so that a distance 3 (e.g. a few centimeters) is formed between the inner side of the sheath material 20 and the body surface 2 of the operator 1. The provision of the distance 3 between the operator 1 and the sheath material 20 has the advantage of heat buffering and a uniform distribution of the heat inside the body suit 10.

Figure 3:
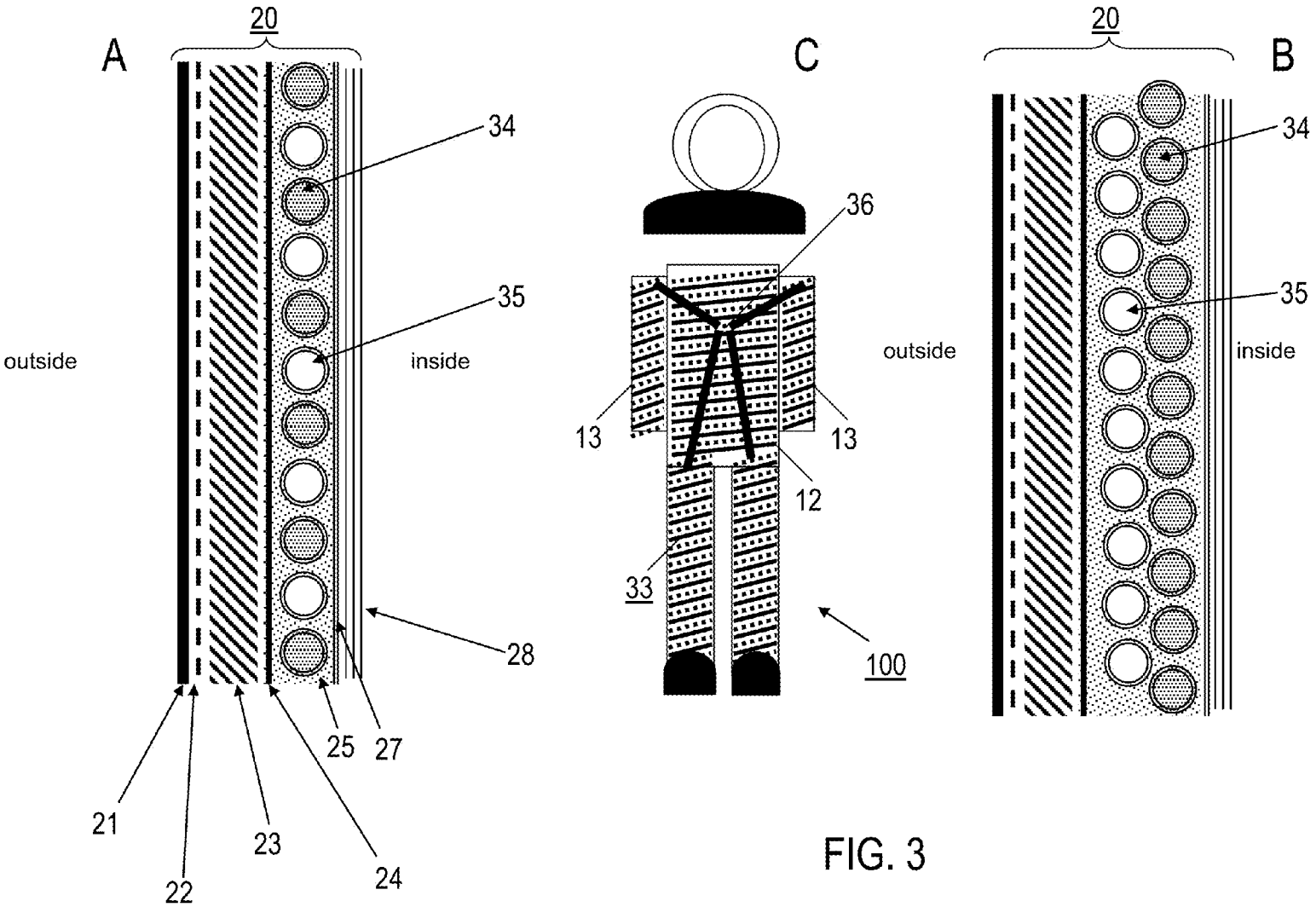
FIG. 3: schematic cross sectional views of the sheath material of a body suit provided with a heating medium circuit.

FIGS. 3A to 3C illustrate a modified variant of the sheath material 20 and of the protective suit 100, for which the heating device is formed by a heating medium circuit 33 with lines 34, 35. The lines 34, 35 form at least one closed ring line. In the back part 60 of the protective suit 100 (see FIG. 1) are located a heating medium source and a heating medium pump, and in the event of provision of several ring lines, a star-shaped distribution for supplying the heating medium to each one of the ring lines. The heating medium circuit 33 comprises a plurality of lines 34, 35 for a gaseous or liquid heating medium. If the heating medium is a liquid, e.g. water, alcohol or a fluid oil, the high heat capacity of the heating medium will prove advantageous. In contrast, the relative high weight of the protective suit 100 and the risk of damage in case of leakage in the heating medium circuit can be disadvantageous.

If the body suit 10 consists of several parts (see FIG. 1B), the lines are coupled between the parts in the assembled state of the body suit 10. In order to avoid leakage of the lines in the separated state of the parts of the body suit 10, the lines are provided with valves, which prevent the liquid from flowing out.

The sheath material 20 has a multi-layer structure with a gas-tight outer skin 21, a stabilization layer 22, an insulation layer 23, which carries a heat reflective foil 24, a heating region 25 in which the lines 34, 35 are arranged, an inner skin 27 and a textile layer 28, as was described above with reference to FIG. 2A. The lines 34, 35 are arranged in a distributed manner in the sheath material 20. In the leg and arm parts 11, 13, the lines 34, 35 run in an annular manner around the extremities of the operator 1, whereas, in the trunk part 12, the lines 34, 35 run in an annular manner around the trunk of the operator 1. A plurality of ring lines may be provided for, e.g. in order to warm up the leg, trunk and arm parts 11, 12 and 13 separately. The at least one ring line is connected with a heating medium heater in the back part 60 (see FIG. 1) or with an external heater.

According to FIG. 3A, the lines 34, 35 are laid in such a way that the supply line with the warm heating medium from the heating medium heater (line 34) alternates with the return line with the cooled heating medium (line 35). According to FIG. 3B, the supply lines with the warm heating medium (line 34) are arranged in an inner layer of the heating region 25, whereas the return lines with the cooled down heating medium (line 35) are arranged in an outer layer of the heating region 25. The heating medium heater delivers the heating medium with a temperature of e.g. 15° C. to 30° C.

The use of cable connections and valves may be avoided if the access opening of the protective suit 100 is arranged above the trunk and arm parts 12, 13 according to FIG. 3C. In this case, the heating medium circuit 33 may be arranged as a closed line system without interruption in the sheath material 20 of the body suit 10. FIG. 3C furthermore illustrates a star-shaped distributor 36 for applying separate flows of the heating medium to the leg, trunk and arm parts 11, 12 and 13.

Figure 4:
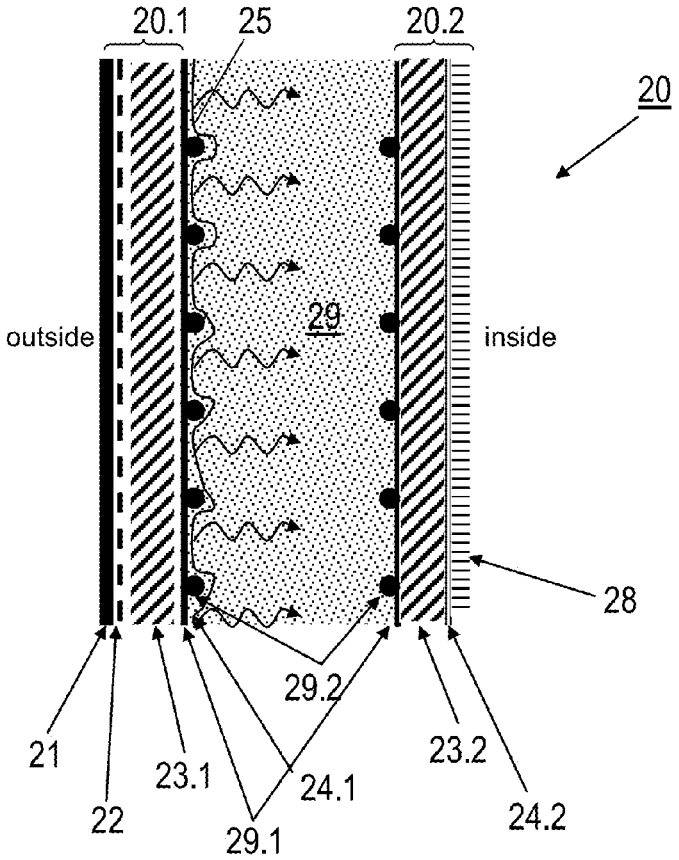
FIG. 4: schematic cross sectional views of further embodiments of the sheath material of the body suit.
Figure 4:
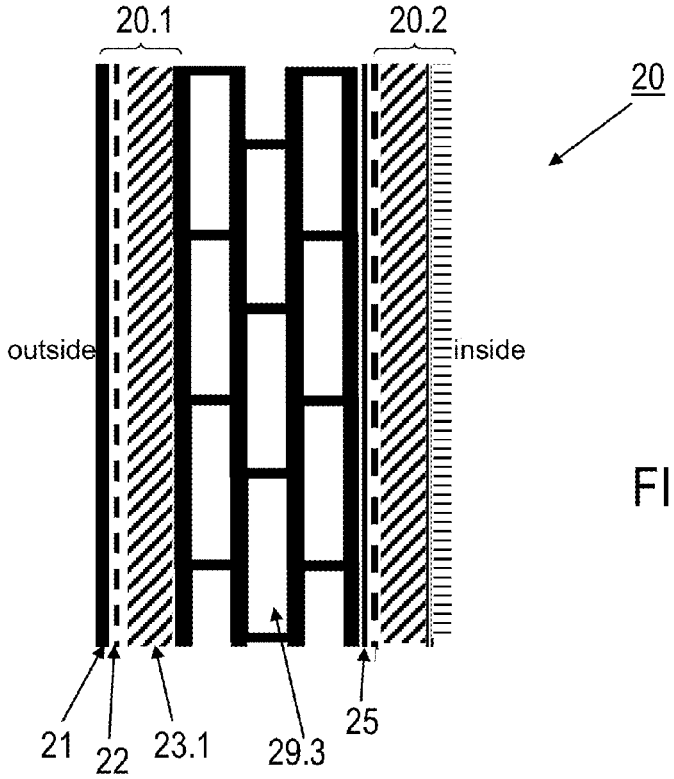

Modified variants of the sheath material 20, which are advantageous with regard to the thermal insulation and the reduction of the required heating power, are illustrated in FIGS. 4A and 4B. The sheath material 20 comprises an outer sheath 20.1 and an inner sheath 20.2. It has a structure similar to the layer sequence in FIG. 2A with an outer skin 21, a stabilization layer 22 and a first insulation layer 23.1, provided with a heat reflective foil 24. Furthermore, a second insulation layer 23.2, likewise provided with a heat reflective foil 24.2, and a textile layer 28 are provided for on the side of the sheath material 20 pointing inwardly. The materials and dimensions of the sheath layers can be selected such as was described with reference to FIG. 2.

Between the first and the second insulation layers 23.1, 23.2 is located a gas-filled (FIG. 4A) or an evacuated (FIG. 4B) intermediate layer 29. The inner surfaces of the gas-filled intermediate layer 29.1 are mechanically stabilized by stabilization ribs 29.1. The heating region 25 with heating layers for electric resistance heating of the sheath material 20 is arranged on the inner surface of the intermediate layer 29 pointing outwardly. According to FIG. 4B, the intermediate layer 29 is not gas filled, but rather formed with evacuated components 29.3 (evacuated plastic modules). In this case, the heating layer 25 is provided on the inner surface of the intermediate layer 29.

Both variants of FIGS. 4A and 4B are characterized by a reduced flexibility or complete rigidity of the sheath material 20 from. In this case, the mobility of the operator 1 wearing the protective suit 100 is guaranteed by the articulation region 14 (see FIG. 1B).

Figure 5:
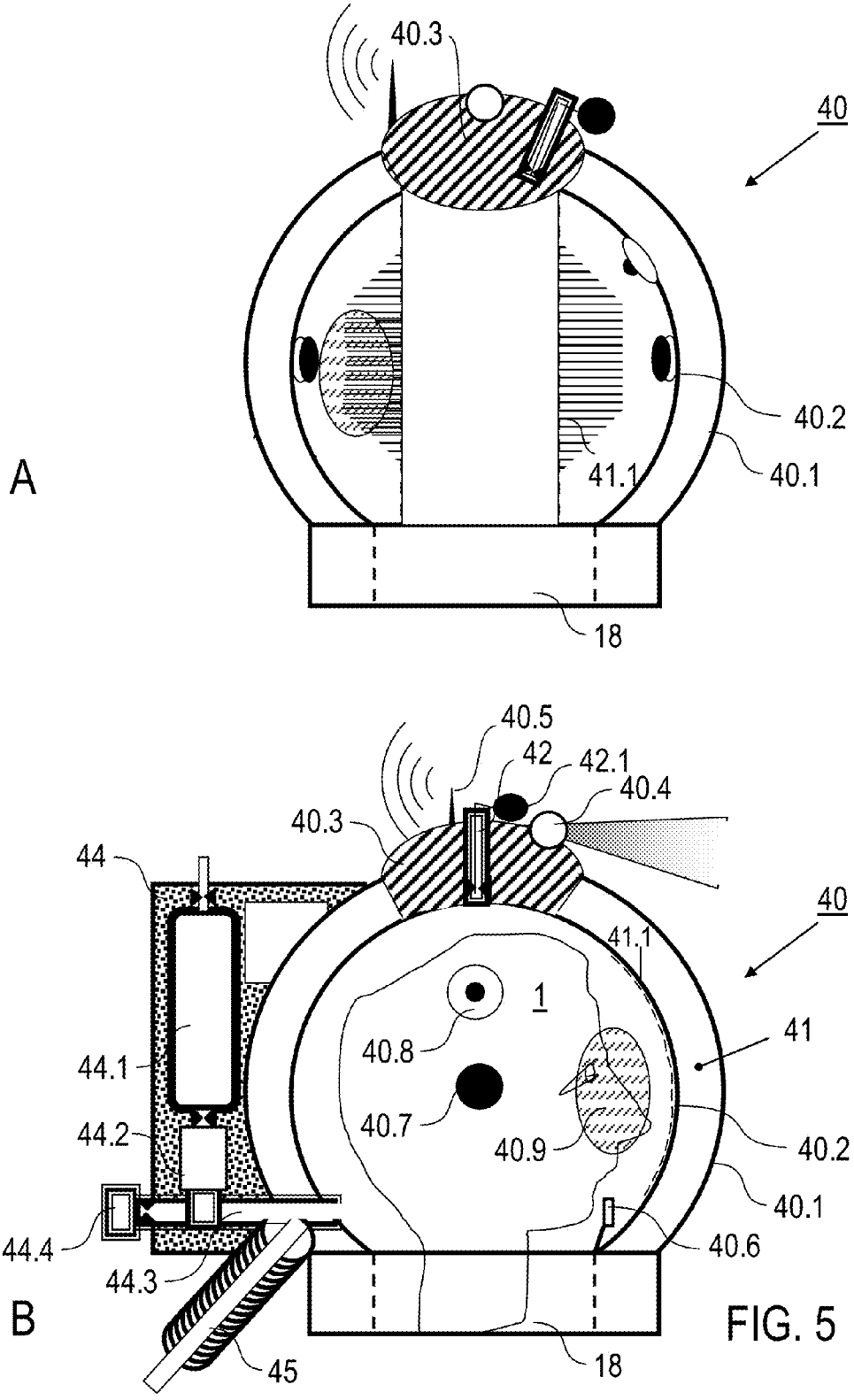
FIGS. 5A and 5B: schematic cross sectional views of a helmet of the protective suit according to the invention.

FIGS. 5A and 5B illustrate the helmet 40 of the protective suit according to the invention 100 in a schematic front view (FIG. 5A) and cross-sectional side view (FIG. 5B). The helmet 40 comprises a cut, double-walled ball made of a transparent plastic material, e.g. copolymer (elastomer), cellulose acetate, acrylonitrile, polystyrene. The ball is formed by an outer wall 40.1 and an inner wall 40.2, which are connected with the coupling ring 18. The space between the outer and inner walls 40.1, 40.2 is evacuated in order to reduce the thermal conduction from the interior of the helmet 40 outwardly. The front side of the helmet 40, which points in the viewing direction of the operator 1, forms a front window 41, which is equipped with a window heater 41.1. Furthermore, the inner surface of the inner wall 40.2 is mirrored, so that thermal radiation is reflected inwardly inside the helmet 40.

Warmed-up breathing air from the breathing air source in the back part 60 is supplied via a thermally insulated supply line 45 into the helmet 40. If a breathing circuit is provided for, breathing may also take place via a mouth piece with valves (not represented), so that fogging of the inner surface of the helmet 40 is advantageously avoided.

On the upper pole of the helmet 40 is arranged a collision protection device 40.3, which serves for protection against mechanical collisions and for accommodating functional components such as a lighting apparatus 40.4, e.g. a white light LED, an antenna 40.5 for wireless communication and/or of a pressure relief valve 42. If the breathing air pressure unintentionally increases in the helmet 40, relief can be achieved with a pressure relief valve 42. Furthermore, the pressure relief valve 42 is provided with an emergency opening element 42.1. The latter can be controlled from the outside in a situation of damage, e.g. in order to admit air into the helmet 40. A window (not represented), which can be opened from the outside, may be provided as a further emergency opening in the helmet 40.

The helmet 40 is furthermore equipped with an emergency supply device 44. The emergency supply device 44 is arranged on the rear side (back of the head) of the helmet 40. It contains a compressed air bottle 44.1, a heating cartridge 44.2 and a valve-controlled connection line 44.3. In case of failure of the breathing air source in the back part 60 (see FIG. 1), the emergency supply device 44 can be actuated in order to conduct tempered breathing air via the connection line 44.3 directly into the helmet 40. The breathing air reserve provided with the compressed air bottle 44.1 is sufficient for emergency supply for e.g. 5 minutes. If emergency supply is required for a longer period of time by means of an external emergency supply device required, supply of breathing air is carried out from the external emergency supply device via a nozzle 44.4, which is connected with the connection line 44.3.

Further functional elements of the helmet 40 comprise a microphone 40.6, ear speakers 40.7, an emergency button 40.8, which can be actuated by a movement of the head of the operator 1, and a rear-view mirror 40.9.

Figure 6:
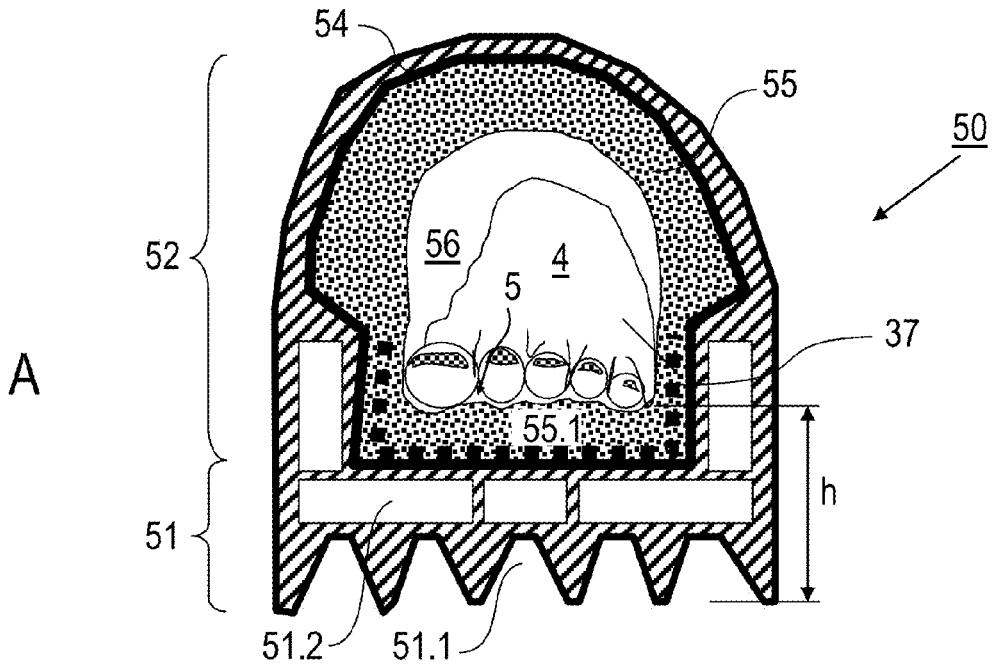
FIGS. 6A and 6B: schematic cross sectional views of a shoe of the protective suit according to the invention.
Figure 6:
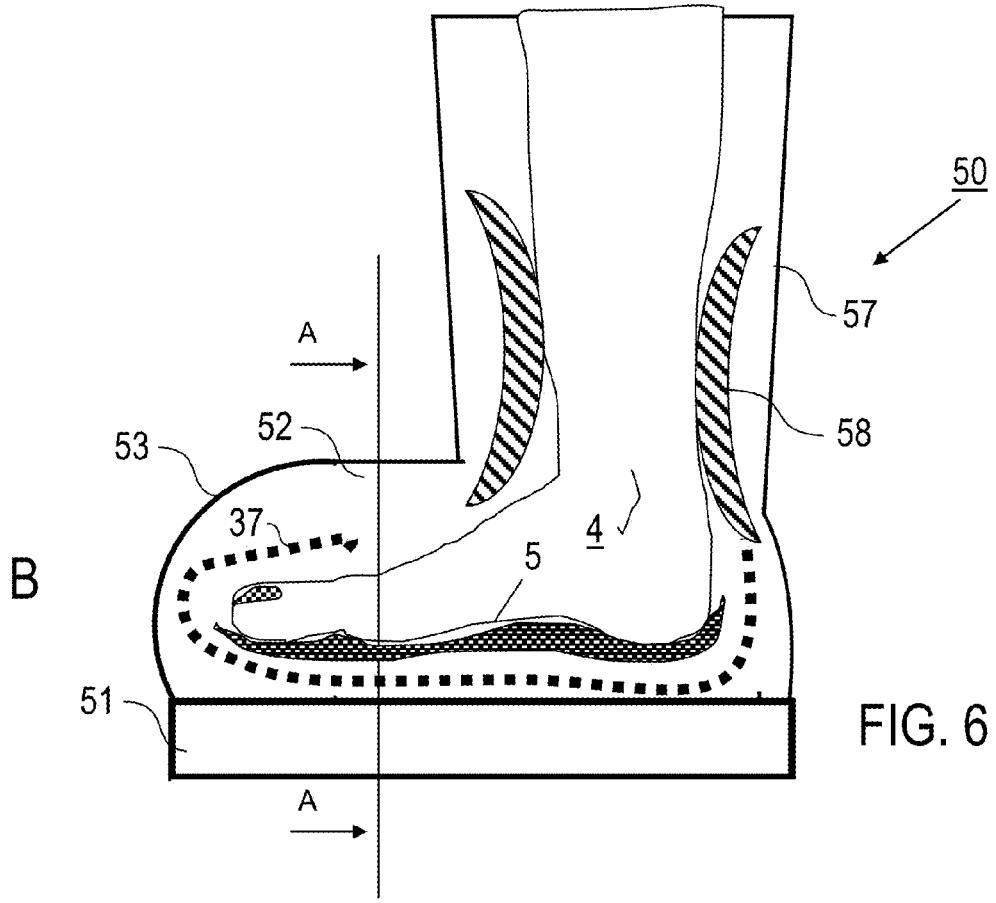

FIGS. 6A and 6B show the shoe 50 of the body suit according to the invention 10 (see FIG. 1) in a schematic longitudinal sectional view of the front region of the shoe (FIG. 6A) and scaled down in a schematic side sectional view (FIG. 6B). The design of the shoes 50 is of particular significance for the safety of the operator, since the shoes 50 come into direct contact with the coldest surfaces in a cooling chamber. On the floor of a cooling chamber is located, e.g. in a thermally insulated trough, an open nitrogen lake, which is covered by a lattice. The operator 1 wearing the protective suit 100 moves on the lattice. The temperature on the floor is almost equal to the temperature of the liquid nitrogen, i.e. approximately 195° C. The shoes 50 are configured to ensure a secure protection of the foot 4 of the operator even if liquid nitrogen splashes upwards from the floor or, in a situation of damage, one steps with the shoe 50 in the liquid nitrogen.

The nitrogen lake of a cooling device of the cooling chamber in the thermally insulated trough typically has a depth, which is not greater than 5 cm. The shoe 50 is therefore equipped with a plateau sole 51 and designed in such a manner that the foot sole 5 of the operator 1 is at a distance h above the floor, which is greater than the depth of the nitrogen lake of the cooling device. The distance h is e.g. greater than 5 cm, in particular greater than 6 cm.

Furthermore, the underside of the shoe 50 is formed in such a way that the shoe 50 is impermeable for liquid nitrogen. The plateau sole 51 and the upper region of the shoe 52 are therefore formed of a low-temperature resistant plastic material, e.g. PTFE, ceramic, glass composite, carbon laminate. On the surface of the shoe 50 is arranged a protective layer 53 against mechanical injury, which consists e.g. of a ceramic, a metal mesh or a plastic mesh.

The plateau sole 51 has a sole profile 51.1 (see FIG. 6A) with which the step-proofness is improved and simultaneously the contact surface with the floor is reduced. Evacuated cavities 51.2 are provided in the plateau sole for further thermal insulation.

Inside the shoe 50 are arranged a heat reflective layer 54, e.g. a plastic foil coated with aluminium, and an insulation layer 55, e.g. made of polymer foam. An electric heating layer 37 (shown dotted), which extends on the underside of the foot 4 and optionally also on the sides or the top side of the foot 4, is embedded in the insulation layer 55 or arranged on the surface of the heat reflective layer 54.

The insulation layer 55 includes a gas-filled interior 56 of the shoe 5 for accommodating the foot 4. The interior 56 is formed clearly larger than would be required for a human foot space. In this way, the operator can wear additionally lined textiles and the shoe 50 can be used by persons with different foot sizes. In order to nevertheless achieve good adaptation with only lower mobility of the foot 4 in the shoe 50, flexible adaptation elements 58 are arranged in the upper 57 of the shoe 50. The adaptation elements 58 give the upper portion of the foot 4 and/or the lower leg 6 sufficient holding in order to allow transmission of the required force to the shoe 50 in the case of movement. Below the foot 4, the insulation layer 55 turns into a shoe insert 55.1, which consists of an elastic and heat-reflective material, e.g. metal-coated plastic foils, PTFE foils, felt layers, foam layers, glass laminates. The shoe insert 55.1 serves for thermal insulation of the foot 4 and enhancement of the adaptability of the shoe 50.

The use of the hands is of particular significance for the operator, who wears the protective suit in the cooling chamber, e.g. during maintenance work or when taking sample containers from a shelf. The operator comes with the gloves 70 (see FIG. 1) into direct contact with cold surfaces. Sample containers with small dimensions, such as sample tubes with a size of few centimeters, must be safely grasped and held with the gloves. In this regard, mobility of the fingers is required, wherein heat transfer from the fingers to the sample container is simultaneously to be minimized.

In general, the glove according to the invention is adapted for use in conjunction with the protective suit or alternatively with a cooling system (e.g. cooling box or chest freezer) under normal pressure at temperatures up to −200° C. In this regard, the glove can be connected with supply and control systems, which, depending on the design of the glove heater (in particular electric resistance heating or heating medium circuit), the design of the glove material (in particular with or without option of unfolding under the action of compressed air) and the use with a protective suit or a cooling system, comprise a current source or a heating medium source, a compressed air source and a sensor device. The compressed air source is connected with a portion of the heating device for warming up the air and drying the air as well as with a flow control device for setting the exhaust air flowing out of the glove. The sensor device preferably comprises temperature sensors in each finger chamber and in the back-of-the-hand and the palm-of-the-hand regions of the glove. Furthermore, sensors may be provided for detection of the air pressure and the air flow in the glove. The sensor device is connected with an alarm device in order to allow signalling of undesirable operating states in the glove. The heating device is designed as was described above with reference to the heating device in the body suit and is explained in the following with further details. Said features are achieved by gloves 70 according to the invention, which are shown in preferred embodiments in FIGS. 7 to 11.

According to FIG. 7A, the glove 70 with several finger chambers 73 is manufactured from a thermally insulating glove material 71, which forms an inner space for accommodating the hand of the operator. The glove material 71 is generally multi-layered and structured just as the sheath material of the body suit, optionally without the storage layer. For example, the thermally insulating glove material 71 comprises from the outside inwards a gas-impermeable, cold resistant outer skin 71.1 and at least one insulation layer 71.2. The outer skin 71.1 comprises a composite material such as a fabric glued with a binder. The insulation layer 71.2 consists e.g. of metal-coated plastic material, PTFE foil, carbon composite material, felt fabric, paraffin or wax composite material and laminated fabrics. On the inner surface of the insulation layer 71.2 is arranged a heat reflective foil for back reflection of thermal radiation into the glove 70.

Compared with the sheath material of the body suit, the thermally insulating glove material 71 can have a simplified structure and a reduced insulation capacity. This is, however, non-critical for the practical use of the protective suit according to the invention, since the glove 70 only forms a small source of heat compared with the rest of the surface of the protective suit.

On the inner surface of the thermal insulating glove material 71 are arranged heating layers (heating foils) 77 for electric resistance heating. The heating layers 77 are arranged in such a way that heat is conducted in particular to the environment of the forearm, the palms of the hands and the fingers. It may be provided for that heating is effected in the front part of the grasping fingers (thumb, index finger, middle finger) only for the top side of the gloves 70 (side pointing to the back of the hand).

On the grasp surfaces of the finger chambers 73 for the grasping fingers are provided grasp areas 74 in which the thermally insulating glove material 71 has a reduced thickness below 1 cm, in particular below 0.5 cm, compared with the rest of the glove 70. The grasp areas 74 advantageously allow for that, despite the low temperature, a finger pressure sensing can be used and the operator get a feel for grasping. The outer surfaces of the grasp areas 74 are covered with a profiled, flexible material, which is advantageous for grasping the sample containers. Due to the profiling of the grasp areas 74, the risk of slipping-out of sample containers is reduced.

As for the body suit 10 (see FIG. 1), it is provided for that the thermally insulating glove material 71 is warmed up from the inside so that also the outer surface (outer skin 71.1) of the thermally insulating glove material 71 remains flexible and pliable. The temperature of the outer skin 71.1 is adjusted e.g. in the range of −10° C. to −60° C.

Figure 2:
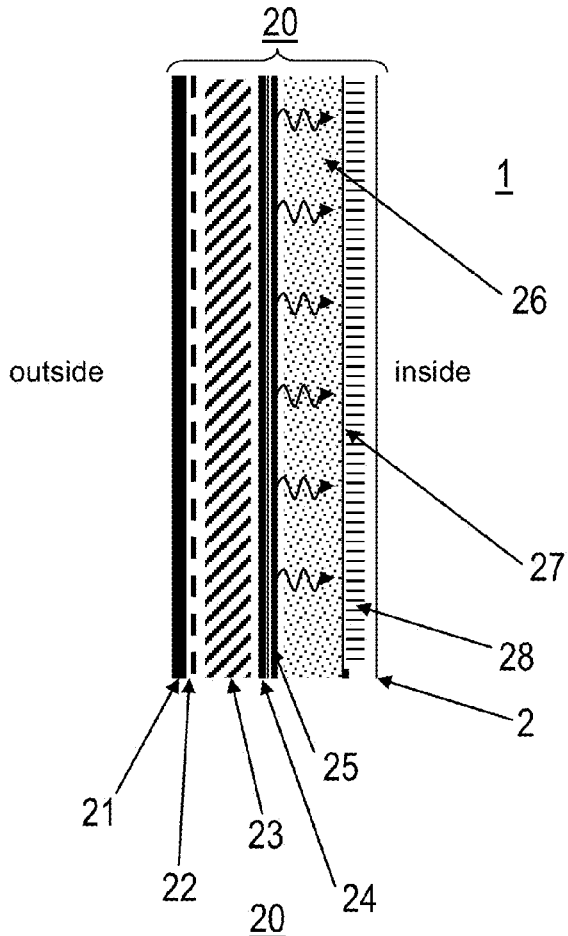
FIG. 2: schematic cross sectional views of the sheath material of a body suit provided with heating layers.
Figure 2:
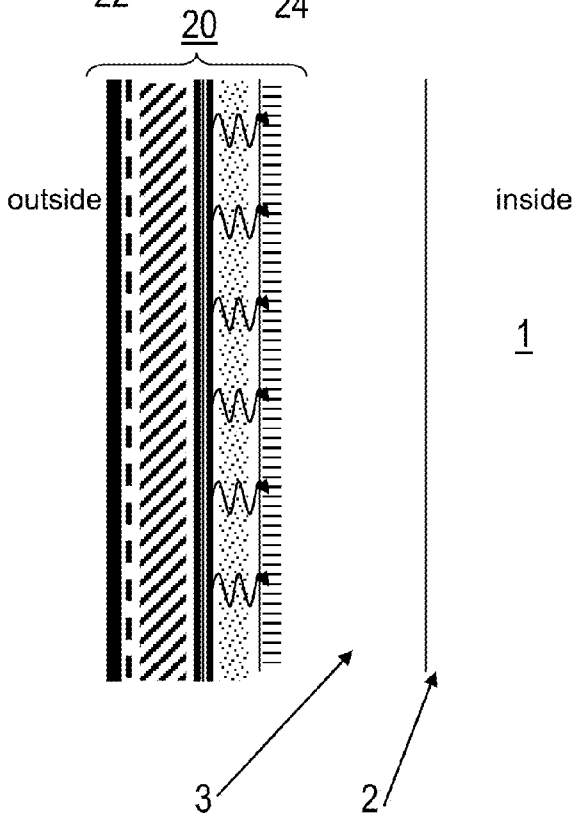

The embodiments of the glove 70 in FIGS. 7A and 7B are illustrated with a schematically shown coupling element 76, which is adapted for connecting the glove 70 with the arm part 13 of the body suit 10 (see FIG. 1). Alternatively, if the gloves are provided on cooling systems, e.g. for manual sample handling in cooling boxes, the coupling elements 76 are connected with an outer wall of the cooling system in such a way that an operator can insert his hands from the outside into the gloves. Furthermore, in this case, there is a connection with an external current source for supplying the electric glove heater via the coupling elements 76.

The gloves 70 can be separated from the body suit 10. Gloves can thus be advantageously replaced depending on the concrete requirements for application in the cooling chamber and the hand size of the operator. Receptacles 75 for sample containers such as sample tubes are provided on the coupling elements 76. The receptacles 75 are adapted to the shape of the sample containers. For example, tubulars are provided for accommodating sample tubes (so-called "straws"), whereas a box or an attachment device is provided for bag-shaped sample containers as the receptacle 75. The receptacles 75 have the advantage that sample containers can be temporarily stored, wherein they must not be held between the fingers and thus remain cool. Deviating from the illustration in FIG. 7, it is, however, possible that the gloves 70 are securely connected with the arm parts 13 of the body suit 10.

FIG. 7B shows an embodiment of the glove 70, which is used in combination with the pressure suit according to FIG. 1B. In this case, lines for gas flowing in (76.1) and flowing off (76.2) are located in the coupling element 76. The glove 70 is warmed up and inflated by the warm gas flowing in (temperature e.g. 25° C. to 35° C.). Additionally, heating layers can be provided inside the glove 70, such as the ones described with reference to FIG. 7A. Due to the overpressure in the glove 70, a gas-filled space 78, in which the hand can move, is created between the hand 6 of the operator and the inner surface of the glove 70. Furthermore, holding elements 72 are provided for in order to support a part of the hand 6 or of the forearm of the operator in the glove 70. Holding elements 72 comprise e.g. one or more rings, which surround the glove 70 in the area of the wrist. The holding elements 72 allow for the hand 6 to slip in and out and simultaneously give the hand 6 sufficient support in order to permit transmission of forces with the finger when grasping.

A particular advantage of the glove 70 according to FIG. 7B consists in the fact that, in the case of undercooling of the fingertips or any other situation of damage, the arm of the operator can be retracted and a first can be formed (shown dashed in FIG. 7B). In this situation, rapid heating of undercooled members is possible.

The line for the gas flowing in (76.1) may, deviating from the illustration, preferably be formed in such a way that the gas flows at the outermost end of the glove 70 between the fingertip and the end of the finger chambers 73 into the glove 70 and then along the fingers over the hand in the direction of the wrist in order to achieve rapid heating of the fingers and the hand and an appropriate distance filled with flowing gas between the finger and the glove. It is advantageous if, in this case, in addition to the pressure, the gas flux is kept constant in particular in its direction of flow.

The glove according to the invention 70 may e.g. be provided as a three-finger-glove or as a five-finger-glove, as is shown schematically in FIGS. 8A and 8B. According to FIG. 8A, a finger chamber 73 for the thumb and the index finger of the operator, respectively, and a further finger chamber 73 for the remaining fingers of the operator are provided for. Part of the heating device 30 is arranged in each of the finger chamber 73. In the illustrated example, the heating device 30 comprises a heating medium circuit with a line 34 for supplying the warmed up heating medium and a line 35 for recycling the cooled-down heating medium, which are split at a distributor 36 into three ring lines. According to FIG. 8B, five finger chambers are accordingly provided for accommodating each one finger of the operator. In this case, the lines 34, 35 of the heating device 30 are split at the distributor 36 into five ring lines, which respectively run on the back-of-the-hand side of the glove 70.

FIGS. 8A and 8B furthermore schematically illustrate a pressure line connection 76.3 with a line for supply of a pressurized gas, e.g. compressed air, into the glove 70 and a line for flowing-out of the pressurized gas. Due to the overpressure, a gas-filled space, in which the hand of the operator can move (see FIG. 7B), is created between the hand of the operator and the inner surface of the glove 70. The pressure line connection 76.3 is conducted by the coupling element 76 (see FIG. 7B) and is connected with a pressurized gas source.

FIG. 8C schematically illustrates that the glove according to the invention 70 can also be equipped with an articulation region 14, which forms in this case a grasp line (folding) on the thumb of the glove 70. The grasp line is e.g. structured in such a way as will be explained below with reference to FIG. 12. According to a modified variant of the glove 70, an articulation region for the formation of the thumb line may be dispensed with. As a substitute, the glove material can be modified in the area of the thumb line in order to guarantee the flexibility of the glove. For example, an interruption may be provided in the area of the thumb line in the layer compound of the glove material, e.g. a gap or an area with a reduced thickness of the insulation layer 71.1 (see FIG. 7A).

Figure 9:
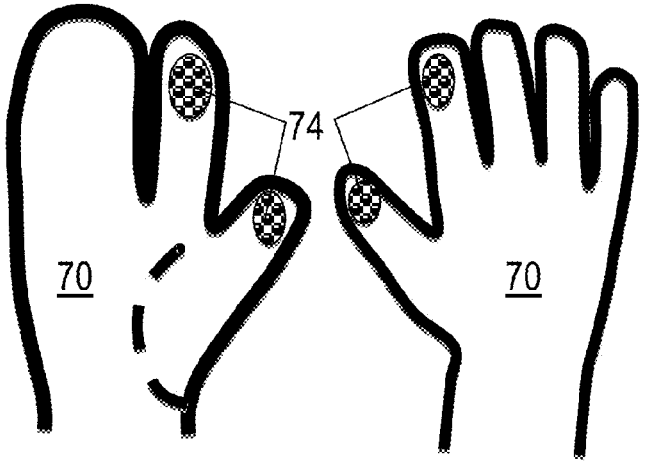
FIG. 9: the cooperation of grasp areas of gloves according to the invention.
Figure 10:
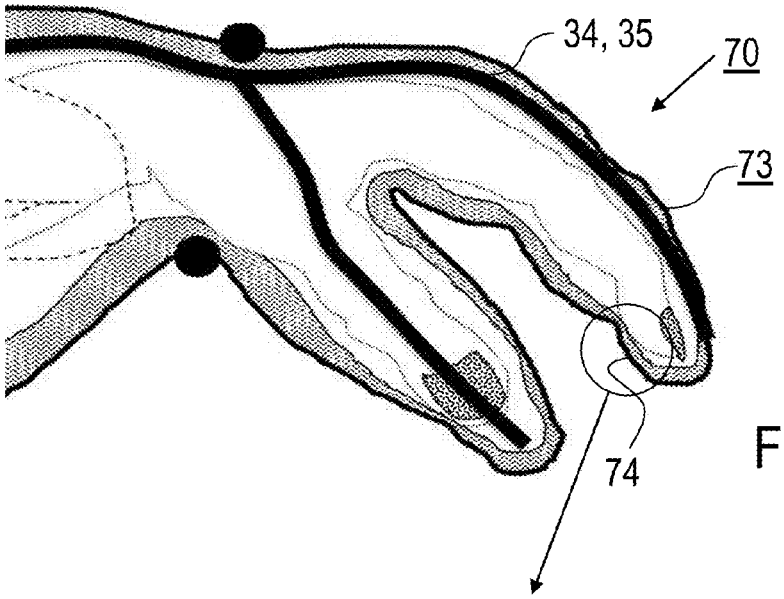
FIG. 10: a schematic illustration of a glove heater with heating medium lines.

FIGS. 9 and 10 illustrate further details of the grasp areas 74 on the finger chambers of the glove 70 according to the invention. According to FIG. 9, the grasp areas 74 are positioned on the parts the finger chambers for accommodating the thumb and the index fingers in the area of the fingertips of hand introduced into the glove 70. The grasp areas 74 are positioned in such a way that they are arranged opposite one another when the glove 70 closes to perform grasping. The grasp areas 74 are characterized by a reduced thickness of the glove material compared with the rest of the glove. As a result, the sense of touch is kept in the grasp areas 74 for the operator. Safe holding e.g. of sample containers is guaranteed, since the holding force is controlled manually and any unintentional slipping-out of the sample containers can be avoided.

The grasp areas 74 represent, in conjunction with the impingement of the glove with an inner pressure, a particularly important feature of the gloves according to the invention. The finger chambers are formed on the finger inner side with the thinner, profiled material for sensitive grasping, even of small objects. The grasp areas 74 lead in the event of contact with an external solid body, which is very cold, to cooling-down of the fingers of the operator in the contact area. The layer are formed in such a way that the contact can also be kept for minutes at a temperature of the solid body of −200° C. without problems. After the release of an object that was held, the cooled-down finger areas of the operator are warmed up. This heating is achieved according to the invention in such a way that, after releasing the handle, due to the inner pressure in the glove, the fingertips are no longer in contact with the glove material, so that they are surrounded warm by the inner medium in the glove and rapidly warm up. The inner pressure in the glove is selected in such a manner that, when grasping, no big mechanical resistance have to be overcome in order to bring the finger surface into contact with the sheath material. This glove finger principle is advantageous in particular for repeated grasping and deposition of objects such as the ones used in cryobanks.

Figure 11:
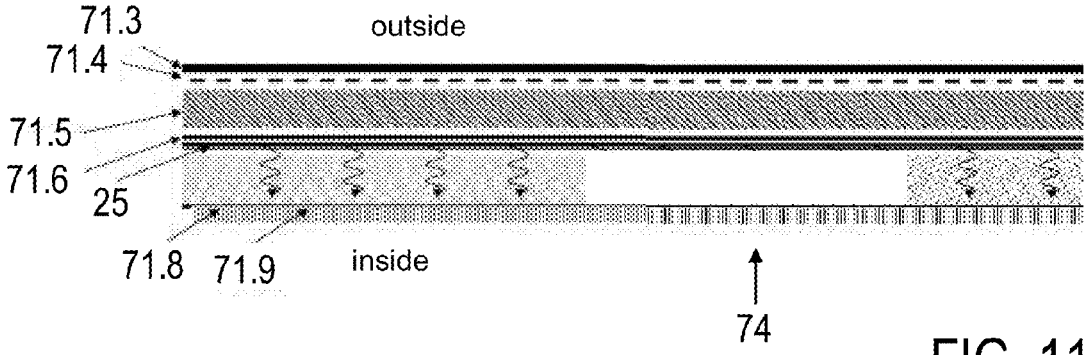
FIG. 11: schematic cross sectional views of the glove material of a glove according to the invention in the environment of the grasp area.

FIG. 10 illustrates a variant of the glove 70 for which the glove heater is formed by a heating medium circuit. The grasp area 74 illustrated by way of example with the index finger according to FIG. 10 is shown enlarged in the schematic sectional view of the glove material in FIG. 11. FIG. 11 shows a grasp area 74 in the glove material, which is formed in this example with a gas-tight outer skin 71.3, a stabilization layer 71.4, an insulation layer 71.5 with a heat reflective foil 71.6, a heating region 25, a storage layer 71.7 with an inner skin 71.8 and a textile layer 71.9. To provide an effective grasp area 74, it is sufficient to leave a gap in the storage layer 71.7 in the glove material with a lateral expansion of e.g. 2 cm.

Figure 12:
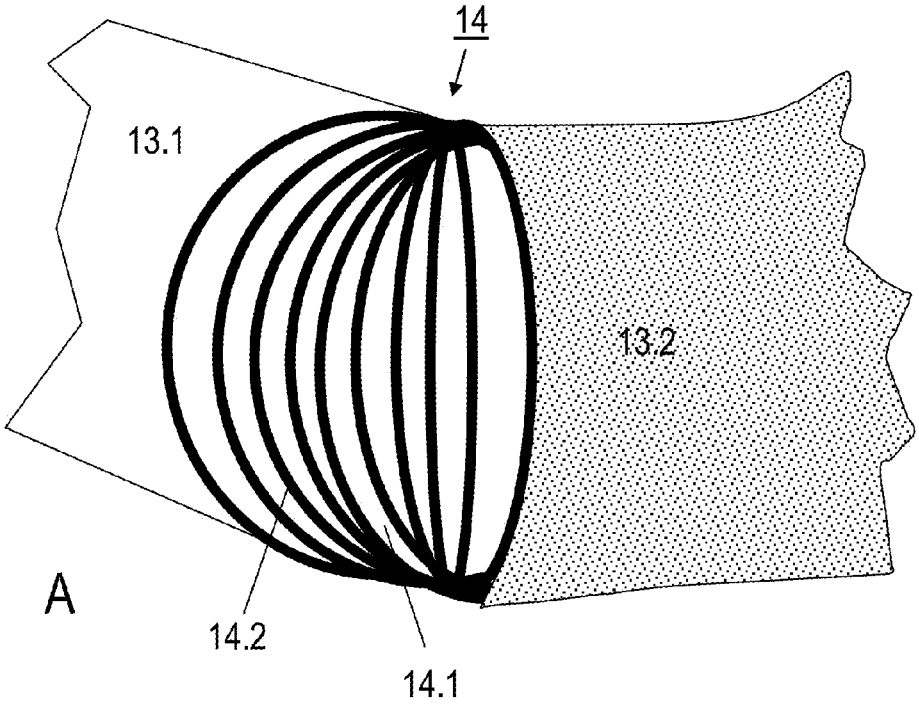
FIG. 12: a schematic illustration of details of an articulation region on a protective suit according to FIG. 1B or a glove according to FIG. 8C.
Figure 12:
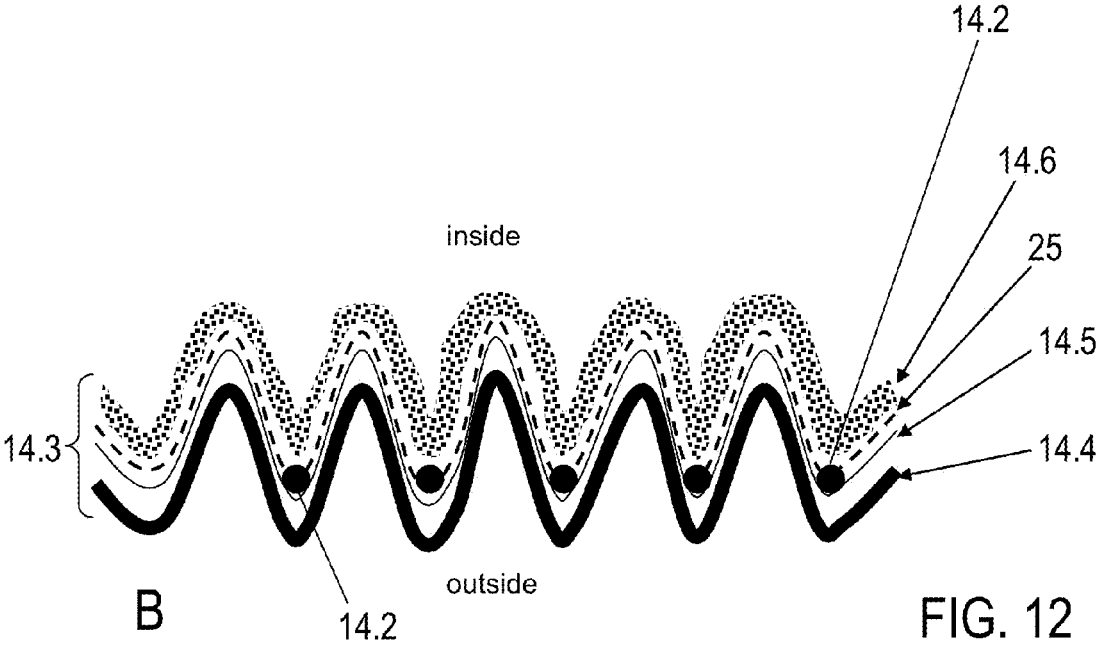

Further details of the articulation regions 14 (see FIGS. 1B and 8C) optionally provided for on the protective suit according to the invention 100 are schematically illustrated in FIGS. 12A and 12B. According to FIG. 12A, an articulation region 14 comprises a movable joint part 14.1. For example, for the elbow joint, the joint part 14.1 is located between rigid, tubular components 13.1, 13.2 of the arm part. The joint part 14.1 is incorporated in the glove material to form the grasp line in the glove 70 (see FIG. 8C). The articulation region 14 has the structure of a bellows connection. Ribs 14.2 that are movable relative to one another are connected to one another by means of a flexible composite material 14.3. The composite material is composed from the outside inwards of a gas-tight, mechanically robust outer skin 14.4, a mechanical coupling layer 14.5, a heating region 25 and an insulation layer 14.6. The mechanical coupling layer 14.5 comprises e.g. a mesh material by means of which the ribs 14.2 are connected with one another. The heating region 25 is provided for electric resistance heating of the articulation region 14. This allows that the whole articulation region itself is movable at an external temperature of up to −200° C. The increased thermal losses in the articulation regions can be accepted due to their low dimension compared with the whole surface of the body suit and due to the significance of their function. Other articulation regions 14, which are provided for on the body suit 10, such as leg joints or waist joints or the grasp line of the glove, have the same structure as shown in FIG. 12.

Figure 13:
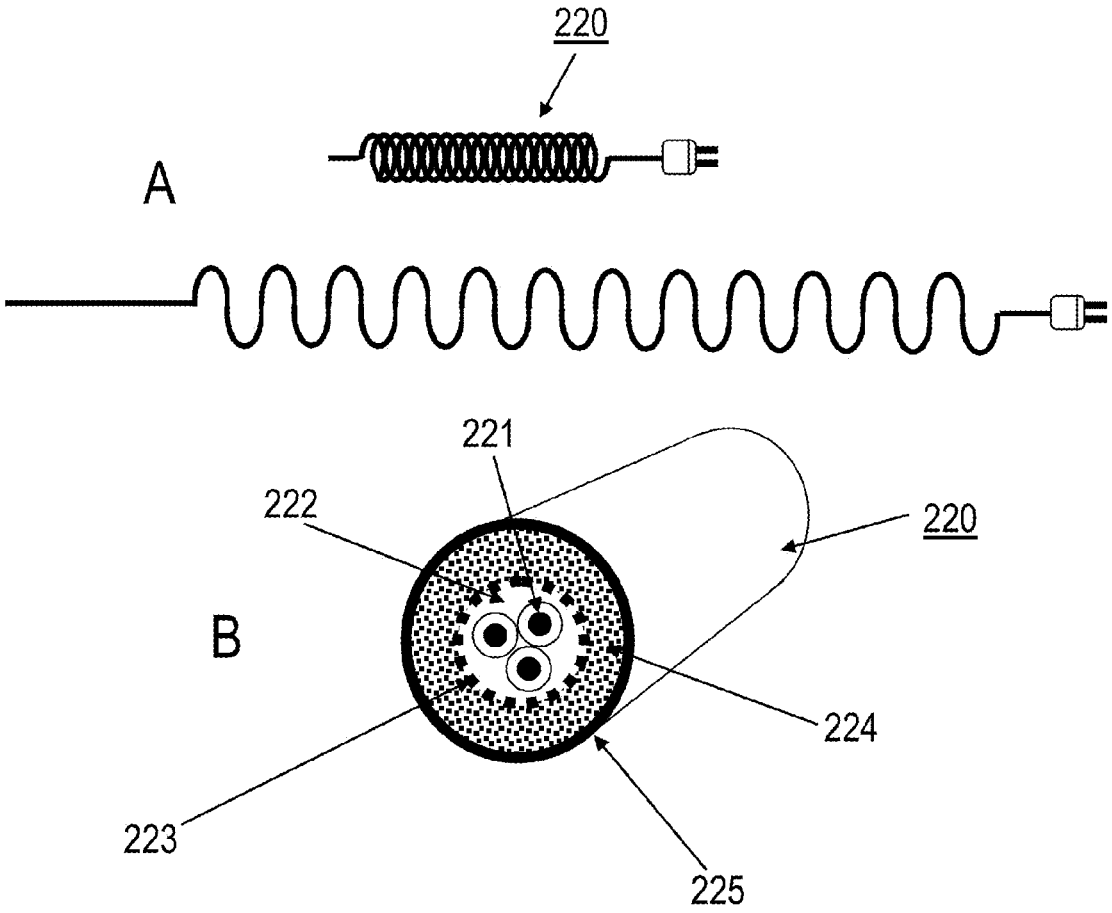
FIG. 13: schematic illustrations of supply lines of a protective suit according to the invention.

If the protective suit according to the invention is connected via supply lines (electric cables, heating medium lines) with external devices, the supply lines must be conducted through the cooling chamber and protected against destruction at the low temperatures. This is schematically illustrated in FIG. 13 by way of example with an electric cable. In order to allow easy access to all parts of the cooling chamber without the risk of tripping in the cooling chamber, the supply lines are preferably formed expandable. This is achieved by the spiral form (FIG. 13A). The spiral-shaped supply line is elastic and its length can be adapted to the concrete conditions of use in the cooling chamber. In order to keep the flexibility of the supply line and prevent any fracture of the insulation materials and sheaths, the supply line 220 is electrically heated, as is shown schematically in FIG. 13B.

Inside the supply line 220 are located electric cables 221, which are embedded in an electric insulation layer 222. On the surface of the electric insulation layer 222 is arranged a heating layer 223 with a heat reflective foil (not shown). On the external side of the heating layer 223 is located a thermal insulation layer 224, which is surrounded by a flexible sheath layer 225, which is resistant against liquid nitrogen. The heating layer 223 is impinged with electric current in such a manner that the temperature of the supply line 220 is increased up to its surface.

Heating of the supply line 220 is preferably performed with a current source in the back part 60 (see FIG. 1). This advantageously guarantees permanent availability of the flexible supply line 220 in the cooling chamber. Others lines such as pressure lines, liquid lines or vacuum lines have the same structure as shown in FIG. 13B.

Figure 14:
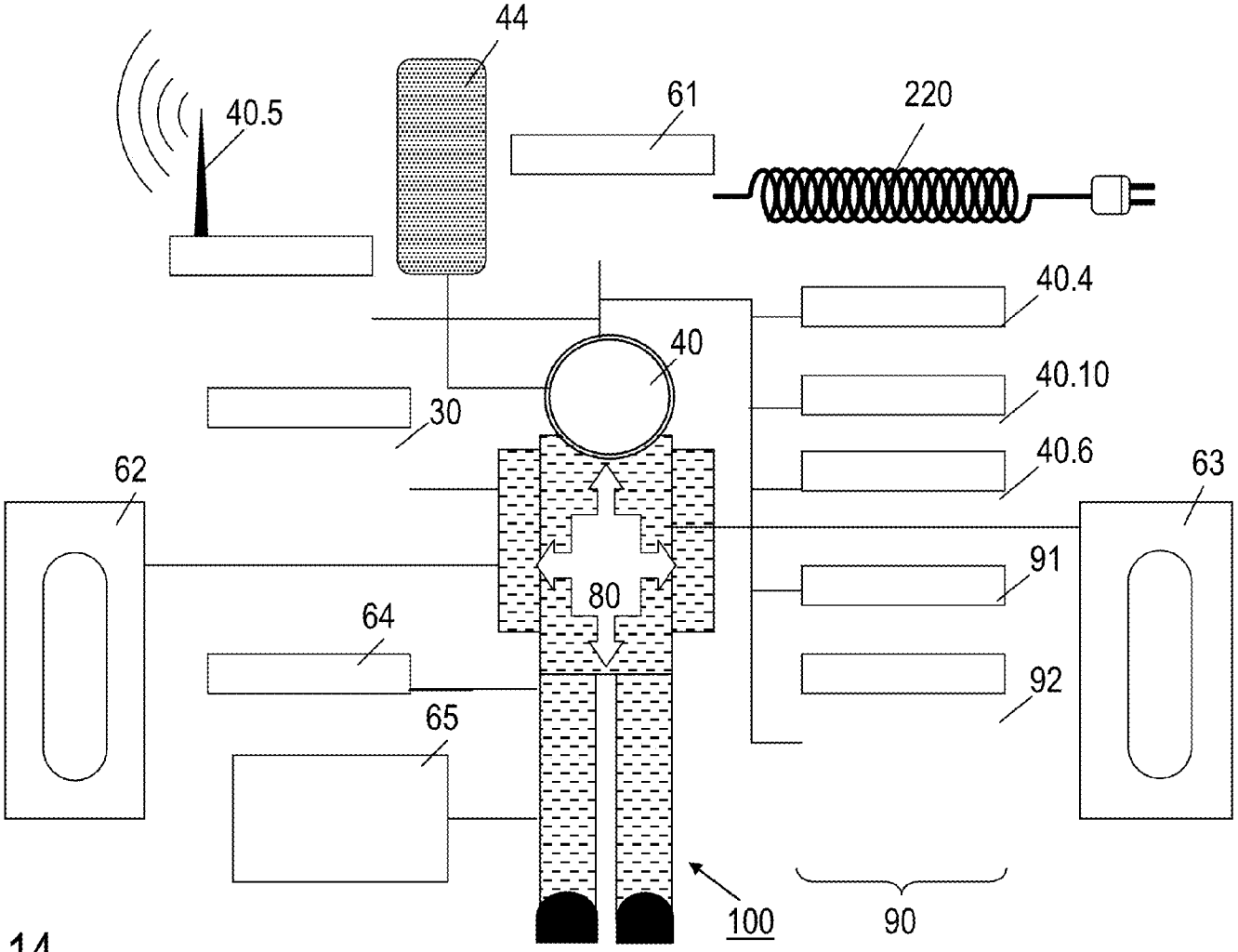
FIG. 14: an overview diagram for illustration of the supply and control system of a protective suit according to the invention.

FIG. 14 shows an overview diagram of the supply and control systems for a protective suit 100 according to the invention with which an operator can work in a cooling chamber under normal pressure at temperatures up to e.g. 200° C. On the protective suit 100 is located a control unit 80 with which signals can be emitted and settings can be carried out on parts of the protective suit 100. The supply and control systems are shown in the representation grouped around the protective suit 100, wherein lines schematically represent connections (signal connections and/or material connections) with the protective suit 100.

The supply and control systems preferably provided for operation of the protective suit 100 comprise a power supply 61 (battery), the heating device 30 and the breathing air source 62. The power supply 61 is provided with thermal insulation in the back part 60 (see FIG. 1) and with a capacitance, which is sufficient for the heater and operation of the suit for a time period of 15 to 60 minutes. Coupling via a supply line 220 to an external power supply, e.g. in the cooling chamber or a neighbouring operations room is provided for. This allows to save or charge the internal power supply 61 or to provide additional energy for special applications. The heating device 30 comprises the heating elements integrated in the protective suit, which are operated electrically or with a heating medium, and a heater control unit.

The breathing air source 62 is likewise arranged with thermal insulation in the back part 60 (see FIG. 1). The breathing air source 62 as such as well as the breathing air lines and valves are thermally insulated and, if necessary, arranged heated. Preferably, the breathing air source 62 is based on a compressed-air system or on a circulatory system with removal of $CO_2$ and supply of oxygen. The breathing air is tempered with a part of the heating device 30 and, if necessary, using sensors in the protective suit 100 and a control circuit.

If the protective suit 100 is designed as a pressure suit (FIG. 1B), a compressed air source 63 is additionally located in the back part 60 (see FIG. 1). Inflatable intermediate layer 29 are supplied with air by the compressed air source 63 for thermal insulation in the sheath material 20 (see FIG. 4A). Furthermore, the compressed air source 63 may be connected with a heating medium circuit. Additionally, an apparatus 65 for pressure generation or for pumping in a liquid circuit or for vacuum generation may be provided for.

The helmet 40 is connected to a radio system with an antenna 40.5 for communication with the external space and others in the cooling chamber, just as a lighting apparatus 40.4, a camera apparatus 40.10 and a microphone 40.6 for radiotelephony communication.

Furthermore, the suit has a sensor device 90 with external sensors 91 (temperature, oxygen content) and internal sensors 92 (temperature, pressure, oxygen content, remaining time, alarm signals, acoustic announcements) at the most various places (extremities, body area, head). In particular the shoes and, there, the shoe soles are equipped with temperature sensors.

When an impermissible deviation of a normal state is recorded with the sensor device 90, an alarm device 64 emits an alarm (alarm signals or messages) to the operator and outwardly. The alarm may e.g. be displayed in the front window 41 of the helmet 40 or reflected into it and/or transmitted acoustically to the operator. Thus, the operator can automatically receive instructions on how to behave, e.g. immediately leaving the cooling chamber, actuation of the emergency supply device or coupling to an external energy source or supply of pressure gas.

Failures of system components would rapidly lead to life-threatening situations under the extreme conditions that prevail in the cooling chamber. The operator is, in the case of nitrogen-cooled chambers, in a non-breathable external atmosphere. Any failure of the breathing air supply would therefore immediately have dramatic consequences. The mere failure of the tempering system for the breathing air is life-threatening. The failure of the suit heating system would also have similar consequences. The materials thus become rigid at temperatures below −100° C. to such an extent that the movability is strongly restricted or a mechanical destruction could be caused by the movement. To avoid these dangers, an emergency supply device 44 is provided for, which is illustrated schematically in FIG. 14 and is integrated on the helmet 40, e.g. in the area of the back of the head (see FIG. 5B). The emergency supply device 44 may alternatively be attached to another point of the suit (e.g. to a belt). The system offers, with the thermal isolation and it own tempering system, an emergency supply of breathing air for approx. 5 minutes, as well as an electric supply for radiotelephony, lighting and heating of the most important elements of the suit (e.g. the joints, feet). Furthermore, instructions are saved in predetermined programs for the different cases, which instructions can be communicated via radio outwardly and language as well as loudspeakers in the helmet to the damaged person.

Generally, at least two persons would be at the same time in the cooling chamber. There are coupling elements in the suits that allow the supply of a failed suit supply system by the second suit. With the emergency supply device 44, the person under damage can try to rescue himself within the remaining time, which is announced or displayed, or persons in the cooling chamber and from the outside can approach or rescue systems can be activated.

The features of the invention which are disclosed in the above description, the claims and the drawings may be important both individually and in combination for implementing the invention in its various designs.

The invention claimed is:

1. A protective suit for an operator in a cooling chamber with atmospheric pressure and a temperature below −90° C., comprising:

a body suit, which has a thermally insulating, gas-tight sheath material and is adapted for accommodating the operator, and a heating device, which is connected to the body suit and is adapted for heating the interior of the protective suit, wherein the protective suit is adapted for use in the cooling chamber, which is cooled with liquid nitrogen or vapor of the liquid nitrogen the sheath material has a multi-layer structure and comprises from outside inwards a gas-tight outer skin, a stabilization layer, an insulation layer with a heat reflective foil, and a heating region, in which are arranged at least parts of the heating device, and the body suit is equipped with shoes, which have plateau soles and sole hollow spaces.

2. The protective suit according to claim 1, in which the heating device comprises a resistance heater, which is arranged in the body suit.

3. The protective suit according to claim 2, in which the heating device comprises heating layers, which are arranged distributed in the body suit.

4. The protective suit according to claim 1, in which the heating device comprises a heating medium circuit for a gaseous or liquid heating medium, which is arranged in the body suit.

5. The protective suit according to claim 4, in which the heating medium circuit comprises a plurality of lines, which are arranged distributed in the body suit.

6. The protective suit according to claim 1, in which the sheath material contains at least one gas-filled or evacuated intermediate layer.

7. The protective suit according to claim 1, in which the heating device is embedded in the sheath material and the thermal conductivity of the sheath material is selected in such a manner that a predominant part of the heat released by the heating device is conducted into the interior of the protective suit and remaining heat heats up the sheath material outwardly in such a manner that it remains flexible at an ambient temperature below −90° C.

8. The protective suit according to claim 1, in which the body suit is equipped with a helmet.

9. The protective suit according to claim 1, in which the body suit comprises leg parts, trunk parts and arm parts, which can be connected via articulation regions.

10. The protective suit according to claim 1, in which the body suit contains a belt device configured to couple with a tether for pulling the operator out of the cooling chamber.

11. The protective suit according to claim 1, in which the body suit has at a front side an access opening, on which layers of the sheath material overlap.

12. The protective suit according to claim 1, in which the protective suit contains an emergency supply device, which comprises at least one of a breathing air reservoir and a coupling device for an external air supply apparatus.

13. The protective suit according to claim 8, in which the helmet has at least one of a front window made of a double-walled, evacuatable window material, a pressure relief valve, a window heater and a rear-view mirror.

14. The protective suit according to claim 1, in which said shoes, which have at least one, protective layers against mechanical injuries, and flexible adaptation elements.

15. The protective suit according to claim 1, in which a breathing gas source is provided for supplying breathable air into the protective suit.

16. The protective suit according to claim 15, in which part of the heating device is configured for heating the air supplied by the breathing gas source.

17. The protective suit according to claim 1, in which the body suit is provided with at least one glove made of a thermally insulating glove material, and the at least one glove contains a glove heater.

18. The protective suit according to claim 17, in which in an interior of the at least one glove, holding elements are provided for, which are configured for fixing a portion of a hand or of a forearm of the operator in the at least one glove, wherein the remaining interior of the at least one glove is dimensioned such that at least fingers of the operator are freely moving in the glove.

19. The protective suit according to claim 17, in which on glove fingers of the at least one glove, grasp areas are provided for, in which the glove material has a reduced thickness compared with the remaining glove.

20. The protective suit according to claim 19, in which the grasp areas on an external side of the glove have an irregular surface.

21. The protective suit according to claim 17, in which the at least one glove is configured to be impinged with an inner pressure so that sufficient space is formed in an interior of the glove for a movement of fingers from a grasping position with a contact of the fingers with the glove material into a heating position without a contact of the fingers with the glove material.

22. The protective suit according to claim 17, in which the at least one glove has receptacles for sample carriers on an external side.

23. A method of using a protective suit according to claim 1 for protecting an operator, wherein the operator wears the protective suit, and the operator stays in a cooling chamber with a temperature below −90° C.

* * * * *